US006772113B1

(12) United States Patent
Fujita et al.

(10) Patent No.: US 6,772,113 B1
(45) Date of Patent: Aug. 3, 2004

(54) DATA PROCESSING APPARATUS FOR PROCESSING SOUND DATA, A DATA PROCESSING METHOD FOR PROCESSING SOUND DATA, A PROGRAM PROVIDING MEDIUM FOR PROCESSING SOUND DATA, AND A RECORDING MEDIUM FOR PROCESSING SOUND DATA

(75) Inventors: Noriaki Fujita, Chiba (JP); Yasuhiro Toguri, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/489,538

(22) Filed: Jan. 21, 2000

(30) Foreign Application Priority Data

Jan. 29, 1999 (JP) ..... P11-023070

(51) Int. Cl.[7] ..... G10L 19/04
(52) U.S. Cl. ..... 704/219; 704/201
(58) Field of Search ..... 84/609; 345/721; 707/104.1; 704/235, 260, 270, 231, 275–278, 219, 201

(56) References Cited

U.S. PATENT DOCUMENTS 5,616,876 A * 4/1997 Cluts ..... 84/609
5,703,795 A * 12/1997 Mankovitz ..... 345/721
5,729,741 A * 3/1998 Liaguno et al. ..... 704/270
5,739,451 A * 4/1998 Winksy et al. ..... 84/609
5,874,686 A * 2/1999 Ghias et al. ..... 84/609
5,963,957 A * 10/1999 Hoffberg ..... 707/104.1
6,201,176 B1 * 3/2001 Yourlo ..... 84/609

OTHER PUBLICATIONS

J. P. Princen & A. Bradley, "Analysis/Synthesis Filter Bank Design Based on Time Domain Aliasing Cancellation," IEEE Transactions on Acoustics, Speech, and Signal Processing, vol. ASSP–34, No. 5, Oct. 1986, pp. 1153–1161.
J. P. Princen et al., "Subband/Transform Coding Using Filter Bank Design Based on Time Domain Aliasing Cancellation," IEEE International Conference on Acoustics, Speech, & Signal Processing, vol. 4, Apr. 1987, pp. 2161–2164.
R. Zelinski & P. Noll, "Adaptive Transform Coding of Speech Signals," IEEE Transactions on Acoustics, Speech, and Signal Processing, vol. ASSP–25, No. 4, Aug. 1977, pp. 299–309.
M. Krasner, "The Critical Band Coder—Digital Encoding of Speech Signals Based on the Perceptual Requirements of the Auditory System," IEEE International Conference on Acoustics, Speech, & Signal Processing, vol. 1–3, Apr. 1980, pp. 327–331.
P.L. Chu, "Quadrature Mirror Filter Design for and Arbitrary Number of Equal Bandwidth Channels," IEEE Transactions on Acoustics, Speech, and Signal Processing, vol. ASSP–33, Feb., 1985, pp. 203–228.

* cited by examiner

*Primary Examiner*—David D. Knepper
(74) *Attorney, Agent, or Firm*—Sonnenschein, Nath & Rosenthal LLP

(57) ABSTRACT

A data processing apparatus and method in which spectral characteristic information and waveform characteristic information within a time area are detected from inputted audio data and the detected spectral characteristic information and waveform characteristic information are recorded together with information indicating a correspondence relationship with the audio data. As a result, an efficient search can be achieved when searching audio data.

25 Claims, 12 Drawing Sheets

DECODER SECTION 154

DATA PROCESSING APPARATUS FOR PROCESSING SOUND DATA, A DATA PROCESSING METHOD FOR PROCESSING SOUND DATA, A PROGRAM PROVIDING MEDIUM FOR PROCESSING SOUND DATA, AND A RECORDING MEDIUM FOR PROCESSING SOUND DATA

TITLE OF THE INVENTION

A data processing apparatus, a data processing method, a program providing medium, and a recording medium

BACKGROUND OF THE INVENTION

The present invention relates to a data processing apparatus and a data processing method for dealing with sound data, a program providing medium for providing a program for providing a program for dealing with sound data, and a recording medium in which sound data is recorded.

In recent years, owing to developments in high-efficiency encoding techniques, it is general to compress/encode sound data when keeping sound data. There is a necessity for a method of efficiently retrieving desired sound data among a number of encoded sound data pieces.

FIG. 1 shows a functional structure of a conventional sound data retrieving apparatus. Sound data (hereinafter called encoded sound data) which has been subjected to predetermined compression encoding processing, and a retrieving text database which describes attribute information associated with the encoded sound data (e.g., title, creator's name, creation data, classification of the content, and the like) are previously recorded in the database 156 of this sound data retrieving apparatus.

The retrieving condition input section 151 receives an input of a retrieving condition/by a user. For example, attribute information and the signal characteristic or the like of a sample waveform are inputted as a retrieving condition. Further, the retrieving condition input section 151 supplies the attribute retrieving section 152 with attribute information (e.g., name of the creator and the like) inputted as a retrieving condition, and also supplies the comparative determination section 155 with the signal characteristic (e.g., the waveform amplitude and the like) inputted also as a retrieving condition.

The attribute retrieving section 152 retrieves an item which matches with the attribute information inputted through the retrieving condition input section 151, from the retrieving text database recorded in the database 156, and extracts encoded sound data corresponding to the item.

The candidate selection section 153 sequentially outputs the encoded sound data inputted from the attribute retrieving section 152 to the decoding section 154. The decoding section 154 decodes the encoded sound data inputted from the candidate selection section 153 and outputs the data to the comparative determination section 155.

The comparative determination section 155 obtains a level of similarity between the sound data inputted from the decoding section 154 and the signal characteristic of the sample waveform supplied from the retrieving condition input section. If the similarity is a predetermined threshold value or more, the section 155 outputs the sound data as a retrieving result. To obtain the similarity, for example, correlation factors concerning waveform amplitudes, amplitude average values, power distributions or frequency spectrums, and the like are calculated with respect to the sample waveform and the sound data as a target to be retrieved.

Next, explanation will be made of a encoding apparatus which generates encoded sound data previously recorded in the database 156 shown in FIG. 1. Prior to explanation of the structure of the encoding apparatus, a method of compressing/encoding efficiently sound data will be explained.

Methods of efficiently compressing/encoding sound data can be roughly classified into a band division encoding system and a conversion encoding system. However, there is a system which combines both systems.

In the band division encoding system, a discrete-time waveform signal (e.g., sound data) is divided into a plurality of frequency bands by a band division filter such as a quadrature mirror filter (QMF) or the like, and optimal encoding is performed on each of the bands. This system is also called a sub-band encoding system. Details of the quadrature mirror filter are described in, for example, "P. L. Chu, "Quadrature mirror filter design for an arbitrary number of equal bandwidth channels", IEEE Trans. Acoust. Speech, Signal Processing, vol. ASSP-33, pp203-128, February 1985.

The conversion encoding system is also called a block encoding system in which a discrete-time waveform signal is divided into blocks each consisting of a predetermined sample unit, and the signal of this block (called a frame in some cases) is converted into frequency spectrums and is thereafter encoded. The type of the method for thus converting the signal into frequency spectrums is, for example, DFT (Discrete Fourier Transfonn), DCT (Discrete Cosine Transfonn), MDCT (Modified Discrete Cosine Transfonn), or the like. In the MDCT, adjacent blocks on the time axis and converter sections are overlapped on each other, and thus, efficient conversion can be achieved with less block distortion. The details are described in, for example, "Analysis/Synthesis Filter Bank Design Based on Time Domain Aliasing Cancellation": J. P. Princen, A. B. Bradley, IEEE Transactions, ASSP-34, No. 5, October 1986. pp1153–1161", and "Subband/Transfonn Coding Using Filter Band Design Based on Time Domain Aliasing Cancellation": J. J. Princern, A. W. Johnson and A. B. Bradley (ICASSP 1987).

The signal which is divided for every frequency band in the case of the band division encoding system or which is divided into a frequency spectrum in the case of the conversion encoding system is quantized and then encoded. In this manner, the band which causes quantization noise can be restricted with use of an auditory characteristic called a masking effect or the like. In addition, by normalizing each signal before the quantization, effective encoding can be carried out.

For example, if quantization is carried out in the band division encoding system, the signal should be desirably be divided for every bandwidth which is called a critical band.

Bit allocation is performed on each signal thus divided by the frequency bandwidth and thus encoded. For example, if bit allocation is dynamically carried out based on the absolute value of the amplitude of the signal for each band, the quantization noise spectrum is flattened so that the noise energy is minimized. Note that this method is described in, for example, "Adaptive Transform Coding of Speech Signals": R. Zelinski and P. Noll, IEEE Transactions of Accorstics Speech and signal Processing, vol. ASSP-25, No. 4, August 1997. However, there is a problem that this method is not auditorily most preferred since the masking effect is not used.

In addition, if fixed bit allocation is carried out such that an excellent S/N ratio is obtained for every band, for example, a masking effect can be obtained auditorily. However, in cases where the characteristic of a sine wave is measured, there is a problem that an excellent characteristic value cannot be obtained since bit allocation tin is fixed. Note that this method is described in, for example, "The critical band coderdigital encoding of the perceptual requirements of the auditory system": M. A. Kransner, MIT, (ICASSP 1980).

To solve these problems, in a method, all the bits that can be used for bit allocation are divided into dynamic allocation and fixed allocation, and the division ratio is rendered dependent on the input signal such that the rate of the fixed allocation is greater as the spectral distribution of the input signal is smoother, for example, thus achieving efficient encoding.

Meanwhile, in quantization and encoding of sound signals, quantization errors increase in such a waveform that includes a sharp change point of amplitude (hereinafter called an attack) at which the amplitude sharply increases or decreases within a part of a sound waveform increases. Also, in a signal encoded by the conversion encoding system, quantization errors of spectral coefficients at the attack spread over the entire block within a time area during reverse spectral conversion (decoding). Due to influences thereof, auditorily harsh noise called a pre-echo is generated immediately before or after a sharp increase point or sharp decrease point of the amplitude.

To prevent this pre-echo, for example, there is a method (gain control) of previously detecting an attack of a waveform signal and amplifying or damping the gain of the signal before and after the attack, so as to equalize the amplitude of the block in which an attack exists. During encoding according to this method, the position of the gain and information of the level subjected to the gain control are encoded together with the waveform signal subjected to the gain control. During decoding, gain control reversal to that during the encoding is performed, based on the position of the gain and the information of the level subjected to the gain control, and a waveform signal is decoded thereby. Note that this method of performing gain control can be effected for every divided frequency band.

FIG. 2 shows the structure of an encoding apparatus which generates encoded sound data previously recorded on the database 156 shown in FIG. 1. This encoding apparatus compresses and encodes sound data by the conversion encoding system described above.

A spectral converter section 161 converts an inputted sound waveform signal into a spectral coefficient by means of predetermined spectral conversion processing (e.g., DCT) and outputs the coefficient to a quantized section 162. The quantized section 162 normalizes and quantizes the spectral coefficient inputted from the spectral converter section 161 and outputs a quantization spectral coefficient and a quantization parameter (which are a normalization coefficient and a quantization width coefficient) thereby obtained, to a Huffiuan encoder section 163. The Huffinan encoder section 163 performs variable-length encoding on the quantization spectral coefficient and the quantization parameter inputted from the quantization section 162, and outputs the results to a bit-multilayering section 164. The bit-multilayering section 164 multilayers the quantization spectral coefficient and the quantization parameter inputted from the Huffinan encoder section 163, and other encoding parameters into a predetermined bit-stream format.

FIG. 3 shows the structure of the decoder section 154 in FIG. 1. This decoder section 154 decodes encoded sound data generated by the encoding apparatus shown in FIG. 2.

In this encoding section 154, a bit-decomposer section 171 which corresponds to the bit-multilayering section 164 shown in FIG. 2 decomposes inputted encoded sound data into an encoding spectral coefficient and an encoding parameter, and outputs the coefficient and parameter to the Huffinan decoder section 172. The Huffinan decoder section 172 subjects the encoding spectral coefficient and the encoding parameter to decoding which corresponds to the encoding by the Huffinan encoder section 163 in FIG. 2, and outputs a quantization spectral coefficient and a quantization parameter thus obtained, to a reverse quantization section 173. The reverse quantization section 173 reversely quantizes the quantization spectral coefficient and reversely normalizes, and outputs a spectral coefficient thus obtained, to a reverse spectral converter section 174. The reverse spectral converter section 174 performs reverse spectral conversion processing which corresponds to spectral conversion processing by the spectral converter section 161 shown in FIG. 2, on the spectral coefficient inputted from the reverse quantization section 173, and outputs a sound waveform signal thus obtained.

In retrieving by means of the conventional sound data retrieving apparatus described above, it is necessary to decode completely sound data when retrieving compressed and encoded sound data. Therefore, a huge memory capacity is required to record decoded sound data, and besides, an extremely long processing time is required to carry out decoding.

BRIEF SUMMARY OF THE INVENTION

The present invention has been made in view of this situation and has an object of retrieving sound data without completely decoding sound data, when retrieving compressed and encoded sound data.

A first data processing apparatus according to the present invention comprises: sound data input means inputted with sound data; spectral characteristic information detector means for detecting spectral characteristic information from the sound data inputted to the sound data input means; waveform characteristic information detector means for detecting waveform characteristic information within a time area from the sound data inputted to the sound data input means; and recording means for recording the spectral characteristic information detected by the spectral characteristic information detector means and the waveform characteristic information detected by the waveform characteristic information detector means, together with information indicating a correspondence relationship with the sound data inputted to the sound data input means.

A first data processing method according to the present invention comprises: a spectral characteristic detecting step of detecting a spectral characteristic from sound data; a waveform characteristic information detecting step of detecting waveform characteristic information within a time area from the sound data; and a recording step of recording the spectral characteristic information detected in the spectral characteristic information detecting step and the waveform characteristic information detected in the waveform characteristic information detecting step, together with information indicating a correspondence relationship with the sound data.

A first program providing medium for providing a program which makes a computer execute processing, according to the present invention, comprises: a spectral characteristic detecting step of detecting a spectral characteristic from sound data; a waveform characteristic information detecting step of detecting waveform characteristic information within a time area from the sound data; and a recording step of recording the spectral characteristic information detected in the spectral characteristic information detecting step and the waveform characteristic information detected in the waveform characteristic information detecting step, together with information indicating a correspondence relationship with the sound data.

A second data processing apparatus according to the present invention comprises: search condition input means inputted with a search condition for sound data; and search means for searching sound data based on the search condition inputted to the search condition input means, wherein the search means searches sound data which satisfies the search condition by referring to at least spectral characteristic information and waveform characteristic information within a time area, which are previously detected and recorded, from sound data.

A second data processing method according to the present invention comprises: a search condition input step in which a search condition for sound data is inputted; and a search step of searching sound data based on the search condition inputted in the search condition input step, wherein in the search step, sound data which satisfies the search condition is searched by referring to at least spectral characteristic information and waveform characteristic information within a time area, which are previously detected and recorded, from sound data.

A second program providing medium for providing a program which makes a computer execute processing, according to the present invention, comprises: a search condition input step in which a search condition for sound data is inputted; and a search step of referring to at least spectral characteristic information and waveform characteristic information within a time area which are previously detected from sound data and recorded, thereby to search sound data which satisfies the search condition inputted in the search condition input step.

Also, a recording medium according to the present invention is a recording medium on which sound data is recorded and spectral characteristic information detected from the sound data and waveform characteristic information within a time area detected from the sound data are recorded together with information indicating a correspondence relationship with the sound data.

As described above, according to the present invention, it is possible to search sound data efficiently without decoding sound data when searching sound data which is compressed and encoded.

DETAILED DESCRIPTION OF THE INVENTION

In the following, embodiments of the present invention will be explained in details with reference to the drawings.

1. Recording of Sound Data

At first, detailed explanation will be made of recording of sound data.

<Structure of Data Processing Apparatus>

Explained now will be a data processing apparatus which records sound data among data processing apparatuses according to the present invention.

Figure 1:
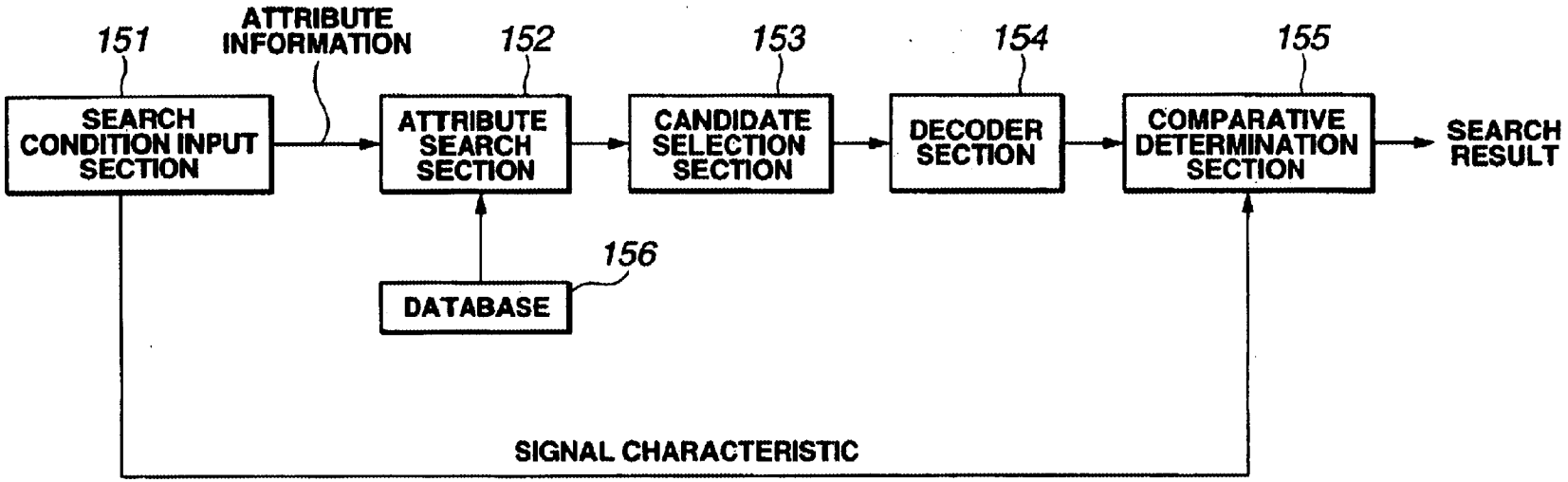
PRIOR ART FIG.1
FIG. 1 is a block diagram showing a structural example of a flow of processing when searching sound data by a conventional sound data searching apparatus.
Figure 2:
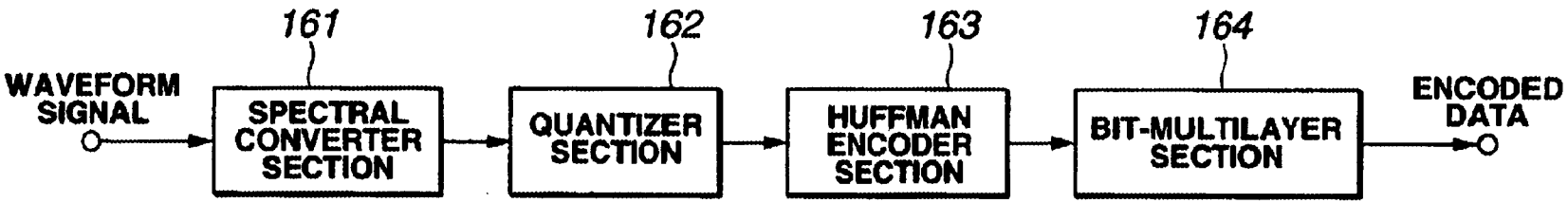
PRIOR ART FIG.2
FIG. 2 is a block diagram showing a structural example of a conventional encoding apparatus.
Figure 3:
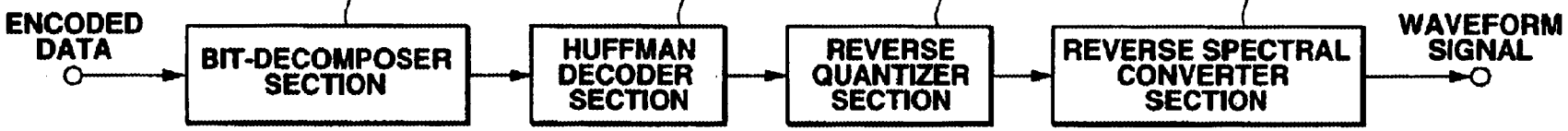
PRIOR ART FIG.3
FIG. 3 is a block diagram showing a structural example of a decoding section of a sound data search apparatus shown in FIG. 1.
Figure 4:
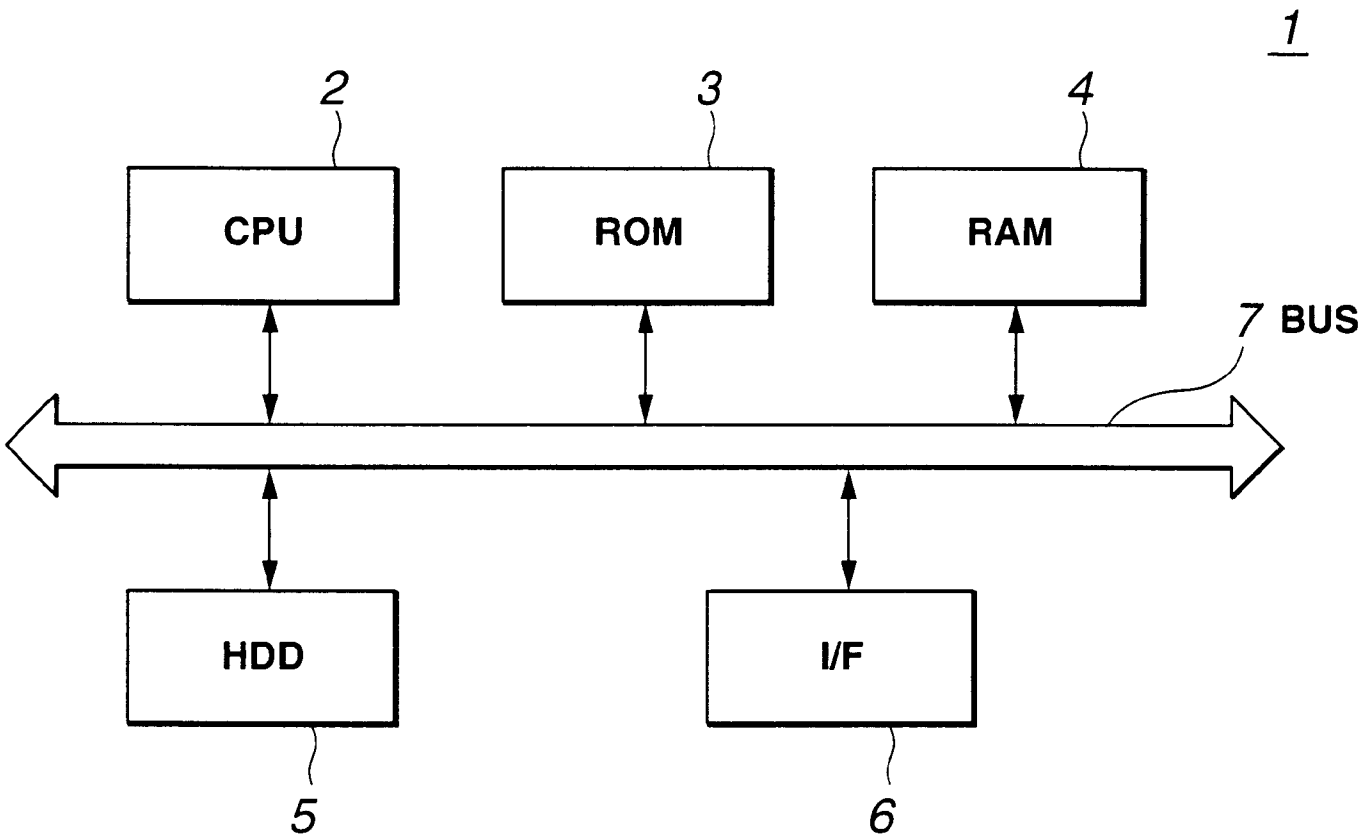
FIG. 4 is a block diagram showing a structural example of a data processing apparatus which performs recording of sound data by applying the present invention.

FIG. 4 shows a structural example of a data processing apparatus which performs recording of sound data by applying the present invention. This data processing apparatus 1 comprises a central processing unit (CPU) 2, a read-only memory (ROM) 3, a random access memory (RAM) 4, a hard disk drive (HDD) 5, and an interface (I/F) 6, which are connected to a bus 7.

The CPU 2 transfers a recording program stored in the HDD 5 to the RAM 4, based on a BIOS (Basic Input/Output System) program stored in the ROM 3, and further reads out and executes the recording program from the RAM 4. Note that this recording program is a program in which processing for recording sound data by applying thereto the present invention and the processing will be specifically explained later.

The HDD 5 is an external storage device and previously stores at least the recording program in this case. Also, sound data is stored into this HDD 5 by executing the recording program and performing recording processing of sound data.

Note that the HDD 5 where the recording program is stored corresponds to a program providing medium in the present invention. The program providing medium according to the present invention is not limited to the HDD 5 but any arbitrary recording medium can be used as long as the medium can store a recording program or the recording program may be provided through a network.

The I/F 6 serves to input/output data, and the sound data stored in the HDD 5 is inputted through this I/F 6. In this case, for example, the I/F 6 is connected with an external memory device such as a flexible disk drive or the like, a communication device such as a network adapter or a modem, an input device such as a keyboard, microphone, or the like. When storing sound data into the HDD 5, the sound data is inputted to the data processing apparatus 1 through those devices.

<Functional Blocks of Data Processing Apparatus>

Figure 5:
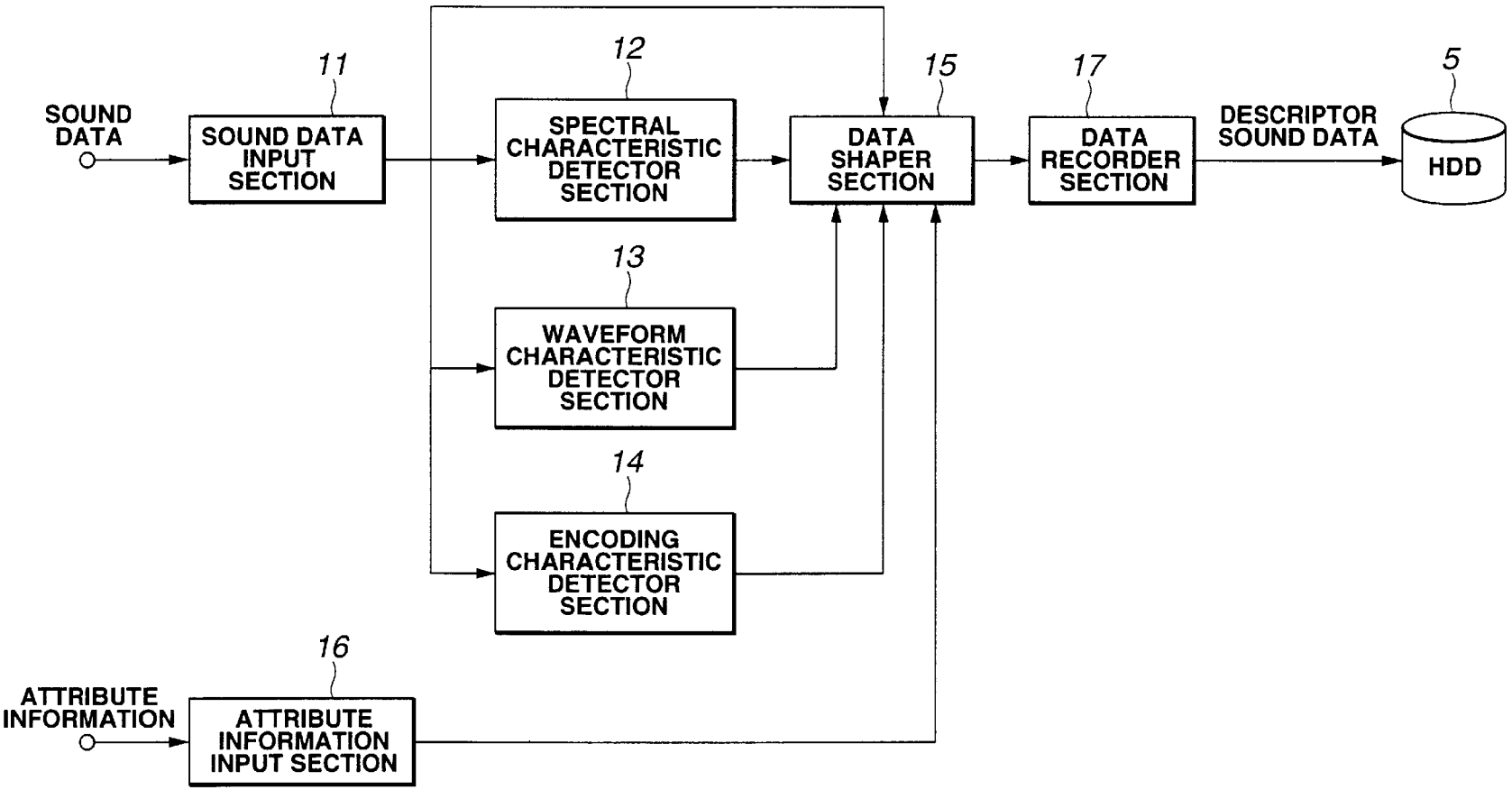
FIG. 5 is a block diagram showing a structural example of functional blocks with respect to a data processing apparatus which performs recording of sound data by applying the present invention.

In the data processing apparatus 1 shown in FIG. 4, a recording program is executed by the CPU 2 thereby to record sound data into the HDD 5 by means of a data processing method which adopts the present invention. FIG. 5 shows a structural example of functional blocks of the data processing apparatus which perform this kind of data processing.

As shown in FIG. 5, the data processing apparatus 1 comprises a spectral characteristic detector section 12 which detects spectral characteristics from sound data inputted to the sound data input section 11, a waveform characteristic detector section 13 which detects waveform characteristics within a time area from the sound data inputted to the sound data input section 11, an encoding characteristic detector section 14 which detects encoding characteristics from the sound data inputted to the sound data input section 11, a data shaping section 15 which shapes data to be recorded into the HDD 5, an attribute information input section 16 through which attribute information is inputted, and a data recording section 17 which records data onto the HDD 5.

In this data processing apparatus 1, when recording sound data onto the HDD the sound data is inputted to the sound data input section 11 through the I/F 6, and attribute information of the sound data is inputted to the attribute information input section 16 through the I/F 6.

The sound data inputted to the sound data input section 11 is supplied to the spectral characteristic detector section 12, the waveform characteristic detector section 13, and the data shaping section 15. If the sound data inputted to the sound data input section 11 is such sound data that is constructed by performing predetermined encoding processing, the sound data is also supplied to the encoding characteristic detector section 14.

The spectral characteristic detector section 12 which has received the sound data detects the spectral characteristic from the sound data, and supplies spectral characteristic information thereof to the data shaping section 15.

The waveform characteristic detector section 13 which has received the sound data detects the waveform characteristic within a time area, and supplies the waveform characteristic information thereof to the data shaping section 15.

The encoding characteristic detector section 14 which has received the sound data subjected to predetermined encoding processing detects encoding the encoding characteristic from the sound data, and supplied encoding characteristic information thereof to the data shaping section 15.

Also, attribute information inputted to the attribute information input section 16 is supplied to the data shaping section 15 from the attribute information input section 16. Note that the attribute information is, for example, the title of sound data, the creator's name, the creation date, the classification of the content, the singer's name, the copyright information, and the like.

The data shaping section 15 generates a descriptor which describes various characteristics, attribute information, and the like of the sound data, from the spectral characteristic information received from the spectral characteristic detector section 12, the waveform characteristic information within a time area received from the waveform characteristic detector section 13, the encoding characteristic information received from the encoding characteristic detector section 14, and the attribute information received from the attribute information input section 16. The descriptor is data which describes various characteristics and attribute information of sound data, and a plurality of descriptors hierarchically related to each other are generated with respect to one sound data piece. Those descriptors will be described in more details later.

Also, the data shaping section 15 sets the descriptor containing an identification information as information which indicates the correspondence relationship between the sound data and the descriptor, and also adds corresponding identification information to sound data. As a result, even if the sound data and the descriptor are recorded separately, they can be retrieved from or be referred to each other.

The descriptor generated by the data shaping section 15 and the identification information added by the data shaping section 15 are supplied to the data recording section 17. Further, the data recording section 17 records the descriptor and the sound data received from the data shaping section 15 onto the HDD 5.

In this data processing apparatus 1, descriptors are generated when recording sound data, and these descriptors are recorded together with the sound data. In this manner, when retrieving sound data, sound data can be efficiently and rapidly retrieved by referring to the descriptors.

Also, in this data processing apparatus 1, a series of stream of sound data is treated as an audio program. An audio program consists of one or more audio objects. The audio objects are, for example, human voices, background sounds, instrumental play sounds, noises, and the like, and an audio program is prepared by compositely combining those audio objects. For example, sound data pieces of different instruments are respectively used as audio objects. By these audio objects, an audio program as a composite combination of sound data pieces played by a plurality of instruments is constructed.

Also, in this data processing apparatus 1, sound data obtained by performing predetermined compression encoding processing on sound data, sound data before performing the compression encoding processing, or sound data obtained by performing predetermined decoding processing on compressed/encoded sound data is dealt with as sound data.

In the following explanation, when emphasizing that the sound data being dealt with is sound data obtained by predetermined compression encoding processing on sound data, the sound data is called encoded sound data while an audio object consisting of encoded sound data is called an encoded audio object.

Also, when emphasizing that the sound data being dealt with is sound data before performing compression encoding processing, the sound data is called original sound data while an audio object consisting of original sound data is called an original audio object.

Further, when emphasizing that the sound data being dealt with is sound data obtained by performing predetermined decoding processing on encoded sound data, the sound data is called decoded sound data while an audio object consisting of decoded sound data is called a decoded audio object.

Note that the decoded sound data is obtained by decoding encoded sound data with a sound effect added thereto, with its pitch cycle or reproducing speed changed, or with its frequency band limited, and is thus different from original sound data.

<Details of Descriptors>

Next, descriptors will be explained in more details. Although specific examples will be cited with respect to descriptors, the embodiment of the present invention is naturally not limited to those examples.

Figure 6:
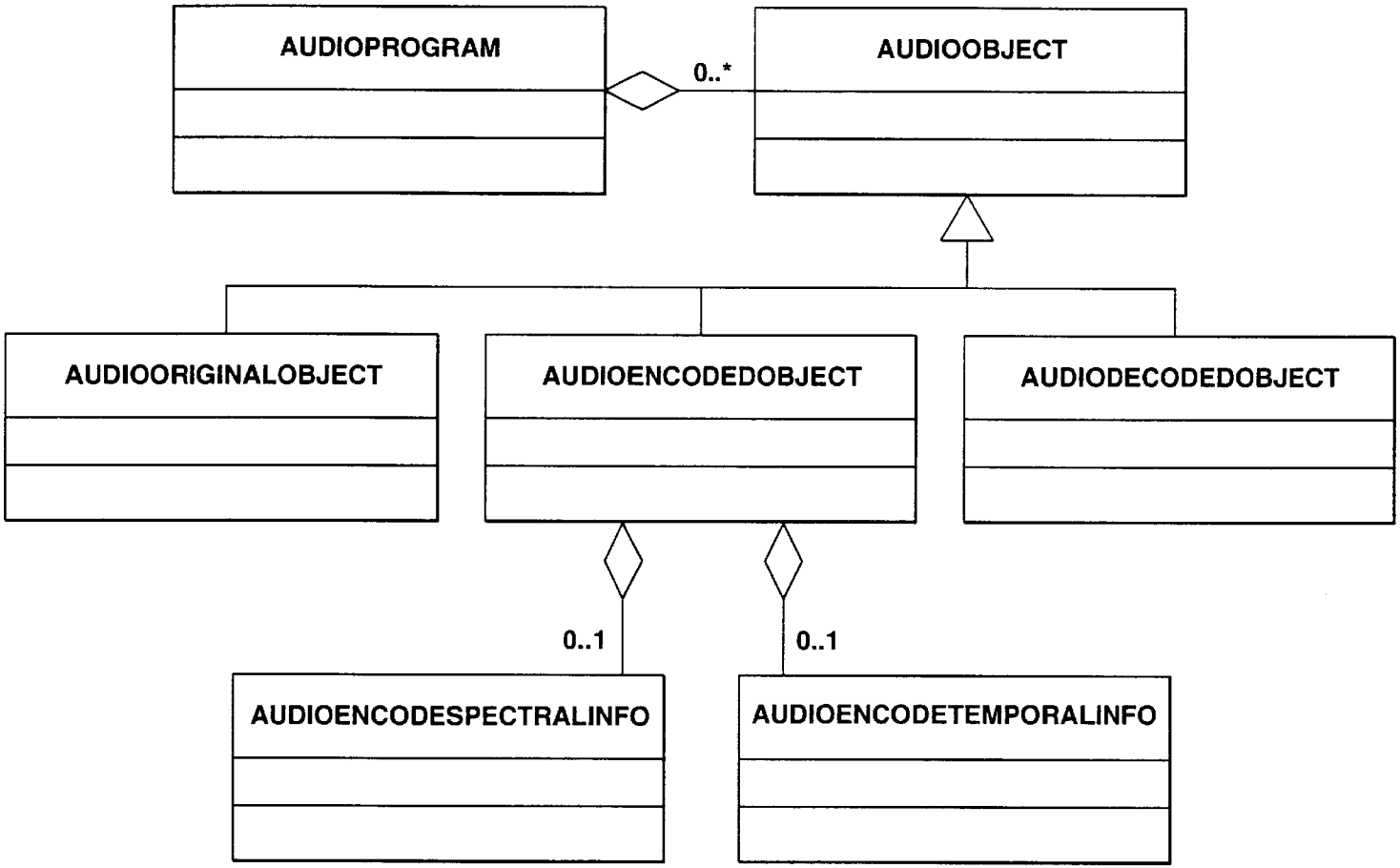
FIG. 6 is a view showing a description scheme expressing correlations between descriptors.

FIG. 6 shows a description scheme. The description scheme expresses mutual relationship between descriptors hierarchically related with each other. FIG. 6 expresses the description scheme in form of class figures according to UML (Unified Modeling Language).

In FIG. 6, each rectangular frame expresses a descriptor. That is, in this example, descriptors are an "AudioProgram descriptor", an "AudioObject descriptor", an "AudioOriginalObject descriptor", an "AudioEncodedObject descriptor", an "AudioDecodedObject descriptor", an "AudioEncodeSpectralInfo descriptor", and an "AudioEncodeTemporalInfo descriptor".

In FIG. 6, each lozenge mark indicates that descriptors on the tail line led from the lozenge mark are parts of the descriptor in the joint side of the lozenge. In other words, the descriptor in the joint side of each lozenge is an aggregation object and descriptors on the tail line led from each lozenge are part objects.

Also, "0..*" indicates that 0 or more descriptors exist. That is, 0 or more AudioObject descriptors exist with respect to one AudioProgram descriptor, and there can be a plurality of AudioObject programs.

F Further, "0.. 1" indicates that 0 or 1 descriptor exists. That is, there may be no AudioEncodeSpectralInfo or AudioEncodeTemporalInfo descriptor that corresponds to an AudioEncodedObject descriptor. If an AudioEncodeSpectralInfo descriptor, one AudioEncodeSpectralInfo descriptor corresponds to one AudioEncodedObject descriptor. If an AudioEncodeTemporalInfo descriptor exists, one AudioEncodeTemporalInfo descriptor corresponds to one AudioEncodedObject descriptor.

Meanwhile, each triangle mark indicates that the descriptor on the tail lie led from the triangle mark inherits the attribute of the descriptor in the joint side of the triangle mark.

In the following, descriptors shown in FIG. 6 will be explained.

The AudioProgram descriptor is a descriptor for describing attribute information and the like of the audio program.

The AudioObject descriptor is a descriptor for describing attribute information and the like of each audio object forming part of the audio program. Since a plurality of audio objects can exist with respect to one audio program, a plurality of AudioObject descriptors (which mean 0 or more descriptors) can exist with respect to one audio program.

The AudioOriginalObject descriptor is a descriptor for describing attribute information and the like of an original audio object. This AudioOriginalObject descriptor inherits the attribute of the AudioObject descriptor.

The AudioDecodedObject descriptor is a descriptor for describing attribute information and the like of a decoded audio object. This AudioDecodedObject descriptor inherits the attribute of the AudioObject descriptor.

The AudioEncodeSpectralInfo descriptor is a descriptor for describing spectral characteristic information among characteristic information of the encoded audio object.

AudioEncodeTemporalInfo descriptor is a descriptor for describing the waveform characteristic information within a time area among the characteristic information of the encoded audio object.

Explained next will be data contained in each descriptor. In the following explanation, the classes which respectively defame the descriptors will be indicated in forms of descriptions according to the programing language C++, and the data defined in each class will be explained thereafter. Needless to say, each descriptor may contain data other than those cited below.

(1) AudioProgram descriptor

The AudioProgram descriptor is defamed by the following class.

```
AudioProgram
  {int AudioProgramID;
    int AudioProgramCategory;
    int AudioProgramNameLength;
    int AudioProgramAuthInfoLength;
    char AudioProgramNamei
      [AudioProgramNameLength];
    char AudioProgramAuthInfo
      [AudioProgralAuthInfoLength];
    char AudioProgramConfigInfo[16];
    int AudioObjectsNumber;
    for(i=0; i<AudioObjectsNumber;i++){int
      AudioObjectID[i];
    }
  }
```

The "AudioProgramID" is an identification number for identifying only one corresponding audio program and is uniformly attached with respect to an audio program. That is, there is a one-to-one correspondence between the audio program and the AudioProgram descriptor. An audio program corresponding to an AudioProgram descriptor is specified by the "AudioProgramID". Note that the "AudioProgramID" can be a search key for making a search using the identification number as a search key.

The "AudioProgramCategory" expresses the type of the category of a corresponding audio program. The "AudioProgramCategory" can be a search key in case of making a search using the type of the category of an audio program as a search key. Also, when outputting a search result, the "AudioProgramCategory" can be outputted as attribute information of the searched audio program.

C The "AudioProgramNameLength" expresses the number of letters of text data of the program of a corresponding audio program.

The "AudioProgramAuthInfoLength" expresses the number of letters of copyright information of a corresponding audio program.

The "AudioProgramName[AudioProgramNameLength]" expresses the program name of a corresponding audio program. The "AudioProgramName [AudioProgramNameLength]" can be a search key in case of making a search using the program name of an audio program as a search key. Also, when outputting a search result, the "AudioProgramName [AudioProgramNameLength]" can be outputted as attributed information of a searched audio program.

The "AudioProgramAuthInfo [AudioProgramAuthInfoLength]" expresses copyright information of a corresponding audio program. The "AudioProgramAuthInfo[AudioProgramAuthInfoLength]" can be a search key in case of making a search using copyright information of an audio program as a search key. Also, when outputting a search result, the "AudioProgramAuthInfo[AudioProgramAuthInfoLength]" is outputted as attribute information of a searched audio program.

The "AudioProgramConfigInfo" expresses structural information of a corresponding audio program. The "AudioProgramConfigInfo" can be a search key in case of searching the structural information of an audio program as a search key. Also, when searching a search result, the "AudioProgramConfigInfo" can be outputted as attribute information of a searched audio program.

The "AudioObjectNumber" expresses the number of audio objects forming part of a corresponding audio program.

The "AudioObjectID[i]" expresses the identification number of the AudioObject descriptor which describes attribute information and the like of the audio objects forming part of a corresponding audio program. The "AudioObjectID[i]" is referred to when searching an audio program from an audio object or when searching an audio object forming part of an audio program from the audio program.

(2) AudioObject descriptor

The AudioObject descriptor is defined by the classes as follows.

```
AudioObject
{int AudioObjectID;
  int AudioObjectCategory;
  int AudioObjectChannelConfig;
  int AudioObjectNameLength;
  int AudioObjectAuthInfoLength;
  char AudioObjectNaie[AudioObjectNameLength];
  char AudioObjectAuthInfo
    [AudioObjectAuthInfoLength];
  int AudioObjectType;
  if(AudioObjectType==Encoded){int AudioEncod-
    edObjectID;
  }
  if(AudioObjectType==Decoded){
  int AudioDecodedObjectID;
  }
}
```

The "AudioObjectID" is the identification number an AudioObject descriptor which describes attribute information and the like of audio objects forming part of an audio program, and is assigned uniformly to the audio objects. The "AudioObjectID" is referred to when searching an audio program from the identification number of an audio object or when searching an audio object forming part of an audio program from the audio program.

The "AudioObjectCategory" expresses the type of the category of a corresponding audio object. The "AudioObjectCategory" can be a search key in case of making a search using the type of the category of the audio object as a search key. Also, when outputting a search result, the "AudioObjectCategory" can be outputted as attribute information of a searched audio object.

The "AudioObjectChannelConfig" expresses channel structural information of a corresponding audio object. The "AudioObjectChannelConfig" can be a search key when making a search using channel structural information of an audio object as a search key.

The "AudioObjectNameLength" expresses the number of letters of text data of the object name of a corresponding audio object.

The "AudioObjectAuthInforLength" expresses the number of letters of text data of copyright information of a corresponding audio object.

The "AudioObjectName[AudioObjectNameLength]" expresses the object name of a corresponding audio object. The "AudioObjectName[AudioObjectNameLength]" can be a search key in case of making a search using the object name of an audio object as a search key. Also, when outputting a search result, the "AudioObjectName [AudioObjectNameLength]" can be outputted as attribute information of a searched audio object.

The "AudioObjectAuthInfo [AudioObjectAuthInfoLength]" expresses copyright information of a corresponding audio object. The "AudioObjectAuthInfo[AudioObjectAuthInfoLength]" can be a search key in case of making a search using copyright information of an audio object as a search key.

The "AudioObjectType" expresses the type of a corresponding audio object. That is, the "AudioObjectType" expresses which of an original audio object, an encoded audio object, and a decoded audio object a corresponding object is.

The "AudioEncodedObjectID" expresses the reference number to a corresponding AudioEncodedObject in case where a corresponding audio object is an encoded audio object. For example, when information concerning an encoded audio object is inputted as a search condition, a corresponding AudioEncodedObject descriptor can be specified by searching a corresponding AudioObject descriptor and by referring to the "AudioEncodedObjectID" therefrom, and information described in the AudioEncodedObject descriptor can be searched accordingly.

The "AudioDecodedObjectID" expresses the reference number to a corresponding AudioDecodedObject descriptor in case where a corresponding audio object is a decoded audio object. For example, when information concerning a decoded audio object is inputted as a search condition, a corresponding AudioDecodedObject descriptor can be specified by searching a corresponding AudioObject descriptor and by referring to the "AudioDecodedObjectID" therefrom, and accordingly, information described in the AudioDecodedObject descriptor can be searched.

The "AudioOriginalObjectID" expresses the reference number to a corresponding AudioOriginalObject descriptor in case where a corresponding audio object is an original audio object. For example, when information concerning an original audio object is inputted as a search condition, a corresponding AudioOriginalObject descriptor can be specified by searching a corresponding AudioObject descriptor and by referring to the "AudioOriginalObjectID" therefrom, and accordingly, information described in the AudioOriginalObject descriptor can be searched.

(3) AudioOriginalObject descriptor

The AudioOriginalObject descriptor is defamed by classes as follows. Note that the AudioOrignalObject descriptor inherits the attribute of the AudioObject descriptor.

```
AudioOriginalObject
{int AudioOriginalObjectID;
  int AudioOriginalType;
}
```

The "AudioOriginalObjectID" expresses the reference number for specifying an AudioOriginalObject descriptor in case where an audio object is an original audio object, and inherent values are respectively set for AudioOriginalObject descriptors. For example, when information concerning an original audio object is inputted as a search condition, a corresponding AudioOriginalObject descriptor can be specified by searching a corresponding AudioObject descriptor and by referring to the "AudioOriginalObjectID" therefrom, and accordingly, information described in the AudioOriginalObject descriptor can be searched.

The "AudioOriginalType" expresses the type of the original audio object. The "AudioOriginalType" can be a search key in case of making a search using the type of an original audio object as a search key. Also, when outputting a search result, the "AudioOriginalType" can be outputted as attribute information of a searched audio object.

(4) AudioEncodedObject descriptor

AudioEncodedObject descriptor is defined by classes as follows. Note that the AudioEncodedObject descriptor inherits the attribute of the AudioObject descriptor.

```
AudioEncodedObject
{int AudioEncodedObjectID;
  int EncodeType;
  int EncodeSamplingFreq;
  int EncodeBitrate;
  int DecodePitch;
  int DecodeSpeed;
  int ChannelNum;
  int FrameSize;
  long StartFrame;
  long EndFrame;
  int OriginalObjectReferenceID;
  int DecodedObjectReferenceID;
  int IsSpectralInfo;
  int IsTemporalInfo;
  int IsReservedInfo;
  if(IsSpectralInfo){
  SpectralInfoID;
  }
  if(IsTemporalInfo){
  TemporalInfoID;
}
```

The "AudioEncodedObjectID" expresses the reference number for specifying an AudioEncodedObject descriptor in case where an audio object is an encoded audio object, and inherent values are respectively set for AudioEncodedObject descriptors. For example, when information concerning an encoded audio object is inputted as a search condition, a corresponding AudioEncodedObject descriptor can be specified by searching a corresponding AudioObject descriptor and by referring to the "AudioEncodedObjectID" therefrom, and accordingly, information described in the AudioEncodedObject descriptor can be searched.

The "EncodeType" expresses the type of an encoding algorithm of a corresponding encoded audio object (e.g., MPEG Audio, MPEG2 AAC SSR, MPEG4 Audio HVXC, or the like). The "EncodeType" can be a search key in case of making a search using the type of an encoding algorithm as a search key. Also, the "EncodeType" can be referred to in case where details of condition determination differ for every encoding algorithm.

The "EncodeSamplingFreq" expresses the sampling frequency when encoding a corresponding audio object, for example, as an integer in units of Hz. The "EncodeSamplingFreq" can be a search key in case of making a search using the sampling frequency of encoded data as a search key. Also, when outputting a search result, the "EncodeSamplingFreq" can be outputted as attribute inform-ation of a searched audio object.

The "EncodeBitrate" expresses the bit rate when encoding a corresponding audio object, for example, as an integer in units of bit/sec. The "EncodeBitrate" can be a search key in case of making a search using the bit rate of encoded data as a search key. Also, when outputting a search result, the "EncodeBitrate" can be outputted as attribute information of a searched object.

The "DecodePitch" is used if the pitch frequency at which decoding should be performed is previously specified when a corresponding encoded audio object is decoded. The "DecodePitch" can be used in case where it is desired to make a search using the pitch frequency of decoded sound data as a search key, and an encoded audio object can be searched. Also, when outputting a search result, the "DecodePitch" can be outputted as attribute information of a searched audio object. If no pitch frequency is previously specified, a value of zero or a negative value is set for the "DecodePitch", and the not-specified "DecodePitch" is not used.

The "DecodeSpeed" is used if the reproducing speed at which decoding should be performed is previously specified when a corresponding encoded audio object is decoded. The "DecodeSpeed" can be used in case where it is desired to make a search using the reproducing speed of decoded sound data as a search key, and an encoded audio object can be searched. Also, when outputting a search result, the "DecodeSpeed" can be outputted as attribute information of a searched audio object. Note that a value indicating the number of times by which the reproducing speed when decoding an encoded audio object is greater than a reproducing speed as a reference. If no reproducing speed is previously specified, a value of zero or a negative value is set for the "DecodePitch", and the not-specified "DecodeSpeed" is not used.

The "ChannelNum" expresses the number of encoded audio channels of a corresponding audio object. The "ChannelNum" can be a search key in case of making a search using the number of channels as a search key.

The "FrameSize" expresses the frame length when encoding a corresponding encoded audio object. In case of encoding not dependent on the block encoding system, for example, a negative value is set for the "FrameSize", and the "FrameSize" itself is not used. In case where a frame length is used as a search key and an encoded audio object using the frame length is retrieved or in case where the search method or the comparison method of a coincidence condition differs depending on the frame length of an encoded audio object, the "FrameSize" is referred to.

The "StartFrame" expresses the frame number of the first frame which maintains data of a corresponding audio object. Data maintained in the AudioEncodeSpectralInfo Info descriptor or AudioEncodeTemporalInfo descriptor depends on the value of the "StartFrame". The value of this "StartFrame" is referred to when performing comparative determination processing as to similarity in search processing.

The "EndFrame" expresses the frame number of the last frame which maintains data of a corresponding encoded audio object. Data maintained in the AudioEncodeSpectralInfo descriptor or AudioEncodeTemporalInfo descriptor depends on the value of the "EndFrame". The value of this "EndFrame" is referred to when performing comparative determination processing as to similarity in search processing.

The "FrameSkip" expresses the interval between frames in which data of a corresponding encoded audio object is maintained. For example, if the value of the "FrameSkip" is 1, data of every frame is maintained. If the value of the "FrameSkip" is 10, data at the interval of 10 frames is maintained. The value of this "FrameSkip" is referred to when comparative determination processing is performed in search processing.

The "OriginalObjectReferenceID" expresses an identification number for referring to an original audio object which bases encoding of a corresponding encoded audio object. Using this identification number as a search key, the original audio object which bases encoding of an encoded audio object can be searched. Also, by comparing the identification number appended to an original audio object with the revalue of an "OriginalObjectReferenceID", an encoded audio object obtained by encoding the original audio object can be searched from an original audio object.

The "DecodedObjectReferenceID" expresses an identification number for referring to a decoded audio object obtained by decoding corresponding encoded audio object data. Using this identification number as a search key, it is possible to search an encoded audio object obtained by decoding encoded audio object data. Also, by comparing the identification number assigned to a decoded audio object with the value of a "DecodedObjectReferenceID", an encoded audio object before decoding a decoded audio object can be searched from the decoded audio object.

The "IsSpectralInfo" is a flag which indicates whether or not there is a descriptor (AudioEncodeSpectralInfo descriptor) which describes information concerning the spectral characteristic, as a descriptor which describes characteristic information and the like of a corresponding encoded audio object. For example, 1 is set if there is a descriptor which describes spectral characteristic information (AudioEncodeSpectralInfo descriptor), and zero is set if not.

The "IsTemporalInfo" is a flag which indicates whether or not there is a descriptor which describes information concerning the waveform characteristic within a time area, as a descriptor which describes characteristic information and the like of a corresponding encoded audio object. For example, 1 is set if there is a descriptor which describes information concerning a waveform characteristic within a time area, and zero is set if not.

The "IsReservedInfo" is a flag which indicates whether or not there is another descriptor than the AudioEncodeSpectralInfo descriptor and the AudioEncodeTemporalInfo descriptor, as a descriptor which describes the characteristic information and the like of a corresponding encoded audio object. For example, 1 is set if there is another descriptor than the AudioEncodeSpectralInfo descriptor and the AudioEncodeTemporalInfo, and zero is set if not.

The "SpectralInfoID" expresses the reference number to the AudioEncodeSpectralInfo descriptor. For example, when an AudioEncodeSpectralInfo descriptor is searched based on the similarity of the spectral characteristic, the "SpectralInfoID" is referred to if an AudioEncodedObject descriptor corresponding to the AudioEncodeSpectralInfo descriptor is searched. Also, for example, when referring to an AudioEncodeSpectralInfo descriptor corresponding to a specified encoded audio object, the "SpectralInfoID" is used to specify the AudioEncodeSpectralInfo descriptor.

The "TempralInfoID" expresses the reference number to the AudioEncodeTemporalInfo descriptor. For example, when an AudioEncodeTemporalInfo descriptor is searched based on the similarity of the waveform characteristic, the "TemporalInfoID" is referred to if an AudioEncodedObject descriptor corresponding to the AudioEncodeTemporalInfo descriptor is searched. Also, for example, when referring to an AudioEncodeTemporalInfo descriptor corresponding to a specified encoded audio object, the "TemporalInfoID" is used to specify the AudioEncodeTemporalInfo descriptor.

(5) AudioDecodedObject descriptor

The AudioDecodedObject descriptor is defamed by classes as follows. Note that the AudioDecodedObject descriptor inherits the attribute of an AudioObject descriptor.

```
AudioDecodedObject
{int AudioDecodedObjectID;
  int DecodedPitch;
  int DecodedSpeed;
  int DecodedFreqband;
}
```

The "AudioDecodedObjectID" expresses the reference number for specifying an AudioDecodedObject descriptor in case where an audio object is a decoded audio object, and inherent values are respectively set for AudioDecodedObject descriptors. For example, when information concerning a decoded audio object is inputted as a search condition, a corresponding AudioDecodedObject descriptor can be specified by searching a corresponding AudioObject descriptor and by referring to the "AudioDecodedObjectID" therefrom, and accordingly, information described in the AudioDecodedObject descriptor can be searched.

The "DecodePitch" expresses the pitch frequency when a corresponding decoded audio object is decoded. Set as the "DecodedPitch" is, for example, a value indicating the number of times by which the pitch frequency when decoded is greater than the pitch frequency as a reference. By using this "DecodedPitch" as a search key, for example, it is possible to search a decoded audio object decoded at the pitch frequency which is twice greater than the pitch frequency as a reference.

The "DecodedSpeed" expresses a reproducing speed when a corresponding decoded audio object is decoded. For example, a value indicating the number of times by which the reproducing speed when decoded is greater than the reproducing speed as a reference is set as the "DecodedSpeed". By using this "DecodedSpeed" as a search key, for example, it is possible to search a decoded audio object decoded at the reproducing speed which is twice greater than the reproducing speed as a reference.

The "DecodedFreqband" expresses a reproducing frequency when a corresponding audio object is decoded. This "DecodedFreqband" is used in case where only a partial frequency band of encoded sound data forming part of an encoded audio object is partially decoded. By using this "DecodedFreqband" as a search key, for example, it is possible to search decoded audio data in which only the frequency band of 1/4 has been decoded.

(6) AudioEncodeSpectralInfo descriptor

The AudioEncodeSpectralInfo descriptor is defined by classes as follows. Note that "Boolean" indicates only the type having only the value of 1 or 0 and is used for a flag.

```
AudioEncodeSpectralInfo
{int SpectralInfoID;
  int PriorityLevel;
  boolean IsParainetric;
  boolean IsSpectralData;
  boolean IsScaleFactor;
  boolean IsHuffData;
  int ChannelNuin;
  int FrameSize;
  long StartFrame;
  long EndFrame;
  long FrameSkip;
  int SpectralDataBlockSize;
  int SpectralType;
  int SpectralUsedNurnber;
  for(frame=StartFrame; frame<EndFrame; frame+=
    FrameSkip) {
    for(ch=0;ch<ChannelNurn;ch++){
    if(IsParainetric){
      int PitchFrequency;
      int HarmonicNum;
      int LspParameterNuin;
      for(I=0;I<HarmonicNum;i++)
      int LpcResidualHarmonic[fraie][ch][i];
    }
```

```
        if(IsSpectralData){
            for(I=0;I<SpectralUsedNurnber;++)
            int SpectralCoeff[frame] [ch] [i];
        }
        if(IsScaleFactor){
            int GlobalScaleFactor[frame] [ch];
            for(i=0;I <ScaleFactorNumber;i++)
            int ScaleFactor[frame] [ch] [i];
        }
        if(IsHuffData) {
            int HuffCodebookID[frame][ch];
        }
    }
  }
}
```

The "[frame]" indicates the frame number and the "[frame]" attached to data indicates that the data corresponds to the [fraie]-th frame. The frame number used here is counted depending on the frame interval from the frame specified by the "StartFrame" to the frame specified by the "EndFrame". Further, the "[frame] [ch] [i]" attached to data indicates that the data corresponds to the [frame]-th frame, i.e., the [i]-th data of the [ch]-th channel arranged for every channel specified by the "ChannelNum".

The "SpectralInfoID" expresses the identification number for specifying an AudioEncodeSpectralInfo descriptor, and inherent values are respectively set for AudioEncodeSpectralInfo descriptors. The "SpectralInfoID" can be a search key in case of making a search using an identification number as a search key.

The "PriorityLevel" expresses the priority of data described in the AudioEncodeSpectralInfo descriptor and is referred to when performing comparative determination processing of similarity in search processing. If the priority is set to be high, the data concerning the spectral characteristic described in the AudioEncodeSpectralInfo descriptor is reflected with priority when performing the comparative determination processing of similarity.

The "IsParainetric" expresses whether or not the "AudioEncodeSpectralInfo" descriptor maintains parametric data such as a pitch frequency, a LSP (Line Spectrum Pair) parameter, hannonics, or the like with respect to a voice signal or the like. That is, the "IsParametric" parametrically expresses the format characteristic or the like of a frequency spectrum. For example, 1 is set if the parametric data is maintained, and zero is set if not.

The "IsScaleFactor" expresses a flag indicating whether or not the "AudioEncodeSpectralInfo" descriptor maintains data of a normalization coefficient (scale factor). For example, 1 is set if data of a normalization coefficient of a frequency spectrum is maintained, and zero is set if not.

If data of a normalization coefficient of a frequency spectrum is maintained, the data of the frequency coefficient maintained in the AudioEncodeSpectralInfo descriptor becomes data of a normalized spectral coefficient.

The "IsHuffData" expresses a flag indicating whether of not the AudioEncodeSpectralInfo descriptor maintains number data of a code book used when encoding a frequency spectrum. For example, 1 is set if number data of a code book is maintained, and zero is set if not.

The "ChannelNum" expresses an encoded number of audio channels of a corresponding encoded audio object. The "ChannelNum" can be a search key in case of making a search using the number of channels as a search key.

The "FrameSize" expresses the frame length when encoding a corresponding encoded audio object. In case of encoding not according to the block encoding system, for example, a negative value or the like is set as the "FrameSize" and the "FrameSize" itself is not used. The "FrameSize" is referred to in case where a frame length is used as a search key and an encoded audio object using the frame length is searched, or in case where the search method or the comparison method of a coincidence condition differs in accordance with the frame length of the encoded audio object.

The "EndFrame" expresses the frame number of the last frame which maintains data of a corresponding encoded audio object. Data maintained in an AudioEncodeSpectralInfo descriptor or an AudioEncodeTemporalInfo descriptor depends on the value of this "EndFrame". The value of this "EndFrame" is referred to when performing comparative determination processing concerning similarity in search processing.

The "FrameSkip" expresses the interval between frames in which data of a corresponding encoded audio object is maintained. For example, if the value of the "FrameSkip" is 1, data of every frame is maintained. If the value of the "FrameSkip" is 10, data is maintained at an interval of 10 frames. The value of this "FrameSkip" is referred to when performing comparative determination processing concerning similarity in search processing.

The "SpectralDataBlockSize" expresses the conversion block length in spectral conversion of spectral data maintained by a corresponding encoded audio object. The value of this "SpectralDataBlockSize" is referred to when performing comparative determination processing concerning similarity in search processing. Specifically, for example, an integral value of 2048 or so is set.

The "SpectralType" expresses the type of the frequency spectral coefficient of a corresponding encoded audio object (such as a power spectrum of DFT, a DCT coefficient, a MDCT coefficient, or the like). The value of this "SpectralType" is referred to when performing comparative determination processing concerning the similarity in search processing.

The "SpectralUsedNurnber" expresses the range of the spectral coefficient which the AudioEncodeSpectralInfo descriptor maintains. For example, if the value of the "SpectralDataBlockSize" is 256 and the value of the "SpectralUsedNurnber" is 16, the AudioEncodeSpectralInfo descriptor maintains the first 16 spectral coefficients among 256 spectral coefficients. In comparative determination processing in search processing, spectral coefficients of the number of the "SpectralUsedNurnber" can be compared at most.

The "PitchFrequency" expresses the pitch frequency which the AudioEncodeSpectralInfo descriptor maintains. The value of this "PitchFrequency" is referred to in order to perform comparative determination processing concerning the similarity of the pitch frequency in case of searching an encoded audio object from the similarity of the pitch frequency of a signal. For example, an integral value in units of Hz is set for the "PitchFrequency".

The "HarmonicNum" expresses the number of harmonics which the AudioEncodeSpectralInfo maintains. The value of this "HarnonicNum" is referred to in order to perform comparative determination processing concerning the similarity of harmonics in case of searching an encoded audio object from the similarity of harmonics of a signal. Note that the harmonics used here expresses a line spectrum which is a multiple of a base frequency by an integer in the power spectrum of a residual signal in LPC (Linear Predictive Coding).

The "LspParameterNum" expresses the number of LSP parameters converted from LPC coefficients which the AudioEncodeSpectralInfo maintains. The value of this "LspParameterNum" is referred to in order to perform comparative determination processing concerning the similarity of LSP parameters in case of searching an encoded audio object from the similarity of LSP parameters of a signal.

The "LpcResidualHarmonic[frame] [ch] [i]" expresses data of hannonics of the [i]-th LPC residual signal in the [ch]-th channel in the [frame]-th frame of a corresponding encoded audio object. This data can be a plurality of data pieces corresponding in number to the number specified by the "HarmonicNum".

The "LspParameter[frame][ch][i]" expresses data of the LSP parameter converted from the [i]-th LPC coefficient on the [ch]-th channel in the [frame]-th frame of a corresponding encoded audio object. That is, the "LspParameter[frame][ch][i]" expresses the parameter which describes the characteristic of the format characteristic of a voice signal. This data can be a plurality of data pieces corresponding in number to the number specified by the "LspParameterNum".

The "SpectralCoeff[frame][ch][i]" expresses data of the [i]-th spectral coefficient on the [ch]-th channel in the [frame]-th frame of a corresponding encoded audio object. When the flag of the "IsScaleFactor" is 1, the "SpectralCoeft [frame][ch][i]" expresses normalized spectral coefficient data normalized by a normalization coefficient (scale factor). The "GlobalScaleFactor[frame][ch][i]" expresses data of the normalization coefficient (global scale factor) on the [ch]-th channel in the [frame]-th frame of a corresponding encoded audio object. The "GlobalScaleFactor[frame][ch][i]" exists only when the flag of the "IsScaleFactor" is 1.

The "ScaleFactor[frame][ch][i]" expresses data of the [i]-th normalization coefficient (local scale factor) on the [ch]-th channel in the [frame]-th frame of a corresponding encoded audio object. The "LocalScaleFactor[frame][ch][i]" exists only when the flag of the "IsScaleFactor" is 1.

The "HuffCodeBookID[frame][ch]" expresses the number of the code book used for encoding data on the [ch]-th channel in the [frame]-th frame of a corresponding audio object. The "HuffCodeBookID[frame] [ch]" exists only when the flag of the "IsHuffData" is 1. By referring to the "HuffCodeBookID[frame] [ch]", it is possible to make a search depending on the similarity of the code book used for encoding.

(7) AudioEncodeTemporalInfo descriptor

The AudioEncodeTemporalInfo descriptor is defined by classes as follows. Note that the "Boolean" indicates the type which have 1 or 0 and used for a flag.

```
AudioEncodeTemporalInfo
{int TemporalInfoID;
  int PriorityLevel;
  boolean IsTemporalAttackInfo;
  boolean IsTemporalPower;
  boolean IsTemporalPitchPeriod;
  int ChannelNuin;
  int FrameSize;
  long StartFrame;
  long EndFrame;
  long FrameSkip;
  if(IsTemporalAttckInfo){
  for(frame=StartFrame;fraie<EndFraie; frame+=
    FraieSkip) {
    for(ch=0;ch<ChannelNui;ch++){
    int WindowNum [fraie] [ch]ch;
    for(win=0;win<WindowNwn[frame] [ch];win++) {
      int AttackNum[frame] [ch] [win];
      for(at=0;at<AttackNum[frame] [ch] [win] ;at++)
        {
          int AttackLocation[frame] [ch] [win] [at];
          int AttackLevel [frame] [ch] [win] [at];
          }
      }
    }
  }
  }
  if(IsTemporalPower){
    for(frame=StartFrame;frame<EndFrame ; frame+=
      Frame Skip){
      for(ch=0;ch<ChannelNum;ch++){
      int TemnpralPower[frame] [ch];
      if(IsTemporaPlitchPeriod){
  for(frame=StartFrame;frame<EndFramei;frame+=
    FrameSkip){
    for(ch=0;ch<ChannelNum;ch++){
    int PitchPeriod[frame] [ch];
    }
  }
  }
```

The [frame] indicates a frame number, and the [frame] attached to data indicates that the data is data which corresponds to the [frame]-th frame. The frame number used here is counted by the frame interval specified by the "FrameSkip" from the frame specified by the "StartFrame" to the frame specified by the "EndFrame". Also, the [ch] indicates the channel number in case where channels are arranged for every channel specified by the "ChannelNum", and the [ch] attached to data indicates the data is data which corresponds to the [ch]-th channel. Also, the [win] indicates the divisional window number where attack information is divided into windows, and the [win] attached to data indicates that the data is data which corresponds to the [win]-th divisional window. Also, the [at] indicates the number of an attack in each window area, and the [at] attached to data indicates that the data is data which corresponds to the [at]-th attack.

The "TemporalInfoID" expresses the identification number for specifying an AudioEncodeTemporalInfo descriptor, and inherent values are respectively set for AudioEncodeTemporalInfor descriptors. The "TemporalInfoID" can be a search key in case of making a search using the identification number as a search key. The "PriorityLevel" expresses the priority of the data described in the AudioEncodeTemporalInfo descriptor, and is referred to when performing comparative determination processing concerning the similarity in search processing. If the priority is set to be high, data concerning the waveform characteristic within a time area described in the AudioEncodeTemporalInfo descriptor is referred to with priority when performing comparative determination processing in search processing.

The "IsTemporalAttackInfo" expresses a flag indicating whether or not the AudioEncodeTemporalInfo descriptor maintains information of an attack (sharp change of amplitude) a waveform within a time area. For example, 1 is set if information of an attack is maintained, and zero is set if not.

The "IsTemporalPower" expresses a flag indicating whether or not the AudioEncodeTemporalInfo descriptor maintains information of the power average characteristic of a signal within a time area. For example, 1 is set if information of a power average characteristic is maintained, and zero is set if not.

The "IsTemporalPitchPeriod" expresses a flag indicating whether or not the AudioEncodeTemporalInfo descriptor maintains information of a pitch cycle characteristic within a time area. For example, 1 is set if information of a pitch cycle characteristic, and zero is set if not.

The "ChannelNum" expresses the number of encoded audio channels of a corresponding encoded audio object. The "ChannelNum" can be a search key in case of making a search using the number of channels as a search key.

The "FrameSize" expresses the frame length when encoding a corresponding encoded audio object. In case of encoding which is not dependent on the block encoding system, for example, a negative value is set for the "FrameSize" but the "FrameSize" itself is not used. The "FrameSize" In case where a frame length is used as a search key and an encoded audio object using the frame length is searched or in case where the search method and the comparative method of a coincidence condition differ depending on the frame length of the encoded audio object.

The "StartFrame" expresses the frame number of the first frame in which data of a corresponding encoded audio object is maintained. Data maintained in the AudioEncodeSpectralInfo descriptor and data maintained in the AudioEncodeTemporalInfor descriptor are dependent on the value of this "StartFrame". The value of this "StartFrame" is referred to when performing comparative determination processing concerning the similarity in search processing.

The "EndFrame" expresses the frame number of the last frame in which data of a corresponding encoded audio object is maintained. Data maintained in the AudioEncodeSpectralInfo descriptor and data maintained in the AudioEncodeTemporalInfor descriptor are dependent on the value of this "EndFrame". The value of this "StartFrame" is referred to when performing comparative determination processing concerning the similarity m search processing.

The "FrameSkip" expresses the interval between frames in which data of a corresponding encoded audio object is maintained. For example, if the value of the "FrameSkip" is 1, data of every frame is maintained. If the value of the "FrameSkip" is 10, data is maintained at the interval of 10 frames. The value of this "FrameSkip" is referred to when comparative determination processing is performed in search processing.

The "WindowNum[frame][ch]" expresses the number of divisional windows in case where attack information on the [ch]-th channel in the [frame]-th frame of a corresponding encoded audio object. The value of this "WindowNum [frame][ch]" is referred to in order to perform comparative determination processing concerning the similarity of the attack characteristic in case of searching an encoded audio object from the similarity of the attack characteristic.

The "AttackNum[frame] [ch] [win]" expresses the number of attacks within the [win]-th divisional window area on the [ch]-th channel in the [frame]-th frame of a corresponding encoded audio object. The "AttackNum[frame][ch] [win]" is referred to in comparative search processing depending on the similarity of the attack characteristic. The value of this "AttackNum[frame] [ch] [win]" is referred to in order to perform comparative determination processing concerning the similarity of the attack characteristic in case of searching an encoded audio object from the similarity of the attack characteristic.

The "AttackLocation[frame] [ch] [win] [at]" expresses the relative position of the [at]-th attack in the [win]-th divisional window area on the [ch]-th channel in the [frame]-th frame of a corresponding encoded audio object. The value of this "AttackLocation[frame] [ch] [win][at]" is referred to in order to perform comparative determination processing concerning the similarity of the attack characteristic in case of searching an encoded audio object from the similarity of the attack characteristic.

The "AttackLevel[fraie][ch][win][at]" expresses the size of the [at]-th attack in the [win]-th divisional window area on the [ch]-th channel in the [frame]-th frame of a corresponding encoded audio object. The value of this "AttackLevel[frame][ch][win][at]" is referred to in order to perform comparative determination processing concerning the similarity of the attack characteristic in case of searching an encoded audio object from the similarity of the attack characteristic.

The "TemporalPower[frame] [ch]" expresses a power average value on the [ch]th channel in the [frame]-th frame of a corresponding encoded audio object. The value of this "TemporalPower[frame][ch]" is referred to in order to perform comparative determination processing concerning the similarity of the power average value characteristic in case of searching an encoded audio object from the similarity of the power average value characteristic.

The "PitchPeriod[frame][ch]" expresses the pitch cycle within a time area on the [ch]-th channel in the [frame]-th frame of a corresponding encoded audio object. The value of this "PitchPeriod [frame][ch]" is referred to in order to perform comparative determination processing concerning the similarity of the pitch cycle characteristic in case of searching an encoded audio object from the similarity of the pitch cycle characteristic.

<Method of Recording Sound Data>

The data processing apparatus 1 shown in FIGS. 4 and 5 records descriptors as described above together with sound data onto the HDD 5, by reading and executing a recording program stored in the HDD 5. The following will explain the method of recording the sound data to be executed on the base of the recording program.

When recording sound data onto the HDD 5, at first, sound data is inputted to a sound data input section 11 through an I/F 6. If there is attribute information of the sound data, the attribute information is inputted to an attribute information input section 16 through the I/F 6. This attribute information is supplied from the attribute information input section 16 to a data shaper section 15.

The sound data inputted to the sound data input section 11 is supplied to a spectral characteristic detector section 12, a waveform characteristic detector section 13, and a data shaper section 15. If the inputted sound data is encoded sound data subjected to predetermined encoding processing, the encoded sound data is also supplied to the encoding characteristic detector section 14.

Next, by the spectral characteristic detector section 12, the spectral characteristic is detected from the sound data, and spectral characteristic information thereof is supplied to the data shaper section 15. Here, if the sound data supplied from the sound data input section is encoded sound data, the spectral characteristic detector section 12 detects information described in the AudioEncodeSpectralInfo descriptor. That is, if the sound data supplied from the sound data input section 11 is encoded sound data, the spectral characteristic detector section 12 detects data of each of the "SpectralDataBlockSize", "SpectralType", "SperctralUsedNumber", "PitchFrequency", "HarmonicNum", "LspParameterNum", "LpcResidualHarmonic[frame] [ch] [i]", "LspParameter [frame][ch][i]", "SpectralCoeff[frame][ch][i]", "GlobalScaleFactor[frame] [ch]", "ScaleFactor[frame] [ch] [i]", and "HuffCodebookID[frame] [ch]" which are described in the AudioEncodeSpectralInfor descriptor from the sound data, and supplies them to the data shaper section 15.

By the waveform characteristic detector section 13, the waveform characteristic within a time area is detected from the sound data, and waveform characteristic information thereof is supplied to the data shaper section 15. If the sound data supplied from the sound data input section 11 is encoded sound data, the waveform characteristic detector section 13 detects information described in the AudioEncodeTemporalInfo descriptor. That is, if the sound data supplied from the sound data input section 11 is encoded sound data, the waveform characteristic detector section 13 detects data of each of the "WindowNum[frame][ch]", "AttackNum [frame] [ch] [win]", "AttackLocation[frame] [ch] [win] [at] ", "AttackLevel [frame] [ch] [win] [at]", "TemporalPower [frame] [ch]", and "PitchPeriod[frame][ch]" which are described in the AudioEncodeTemporalInfo descriptor from the sound data and supplies them to the data shaper section 15.

By the encoding characteristic detector section 14, the encoding characteristic is detected from the sound data, and encoding characteristic information thereof is supplied to the data shaper section 15. Here, the sound data supplied to the encoding characteristic detector section 14 is encoded sound data. Further, the encoding characteristic detector section 14 detects information described in the Mu AudioEncodedObject descriptor. That is, the encoding characteristic detector section 14 detects data of each of the "EncodeType", "EncodeSamplingFreq", "EncodeBitrate", "DecodePitch", "DecodeSpeed", and "ChannelNum", "FrameSize", "StartFrame", and "EndFrame" which are described in the AudioEncodedObject descriptor from the sound data and supplies them to the data shaper section 15.

Next, by the data shaper section 15, each of the descriptors as described above is generated from the spectral characteristic information detected by the spectral characteristic detector section 12, the waveform characteristic information within a time area detected by the waveform characteristic detector section 13, the encoding characteristic information detected by the encoding characteristic detector section 14, and the attribute information supplied from the attribute information input section 16 to the data shaper section 15.

At this time, identification information (AudioProgramID, AudioObjectID, and the like) is contained as information indicating the correspondence relationships between the sound data and the descriptors, in the descriptors, and identification information corresponding thereto is attached to the sound data. In this manner, even if the sound data and the descriptors are recorded separately, they can be searched or referred to from each other.

Next, descriptors generated by the data shaper section 15 and the sound data added with identification information by the data shaper section 15 are supplied to the data recording section 17 and are recorded onto the HDD 5 by the data recording section 17.

By generating descriptors when recording sound data and by recording the descriptors together with sound data, as described above, it is possible to rapidly and efficiently search sound data by referring to the descriptors when searching sound data later.

<Recording Fonns of Sound Data and Descriptors>

Figure 7:
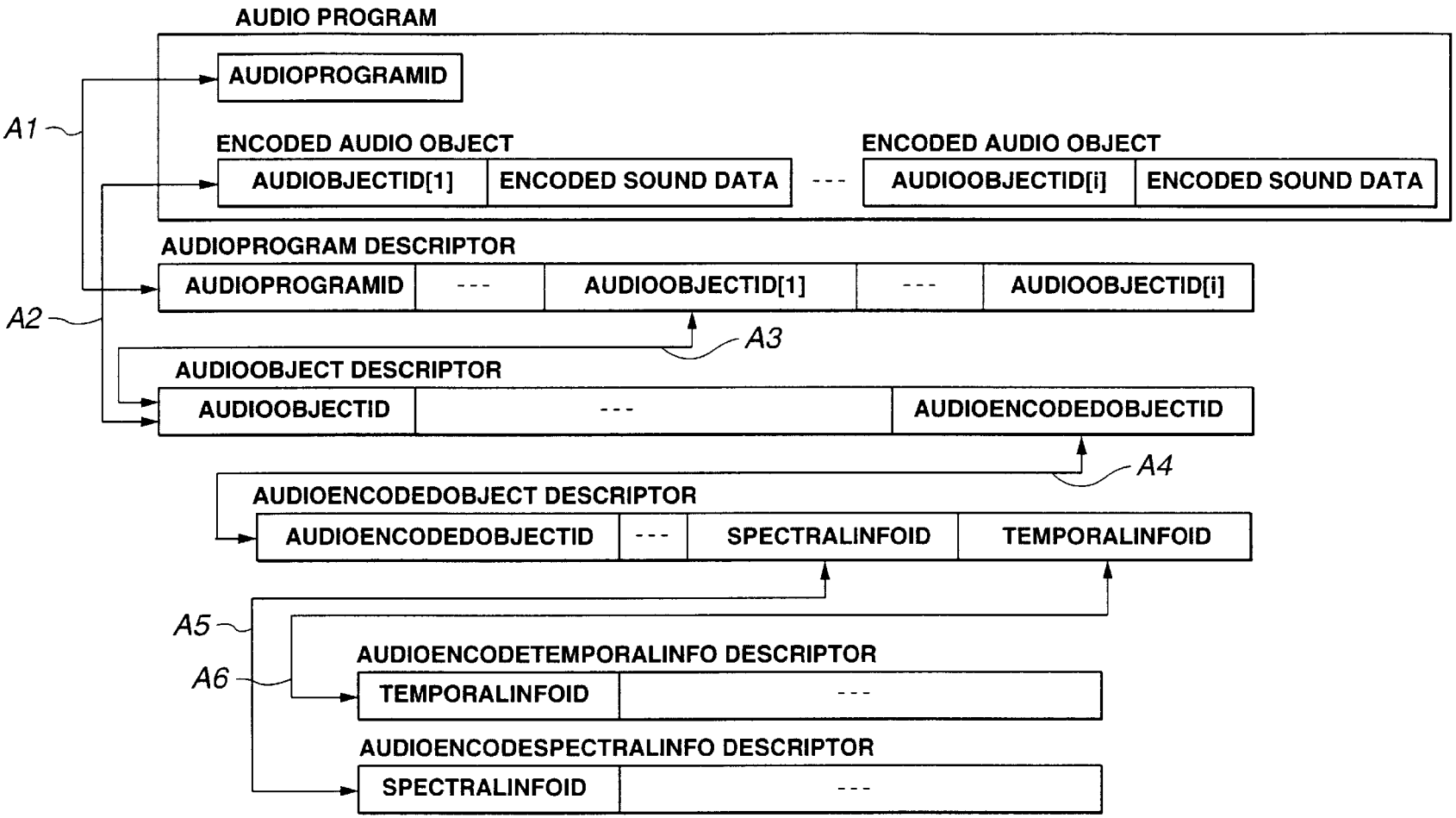
FIG. 7 is a diagram showing a recording form when recording descriptors together with sound data in case where sound data as a target to be recorded is encoded sound data.
Figure 8:
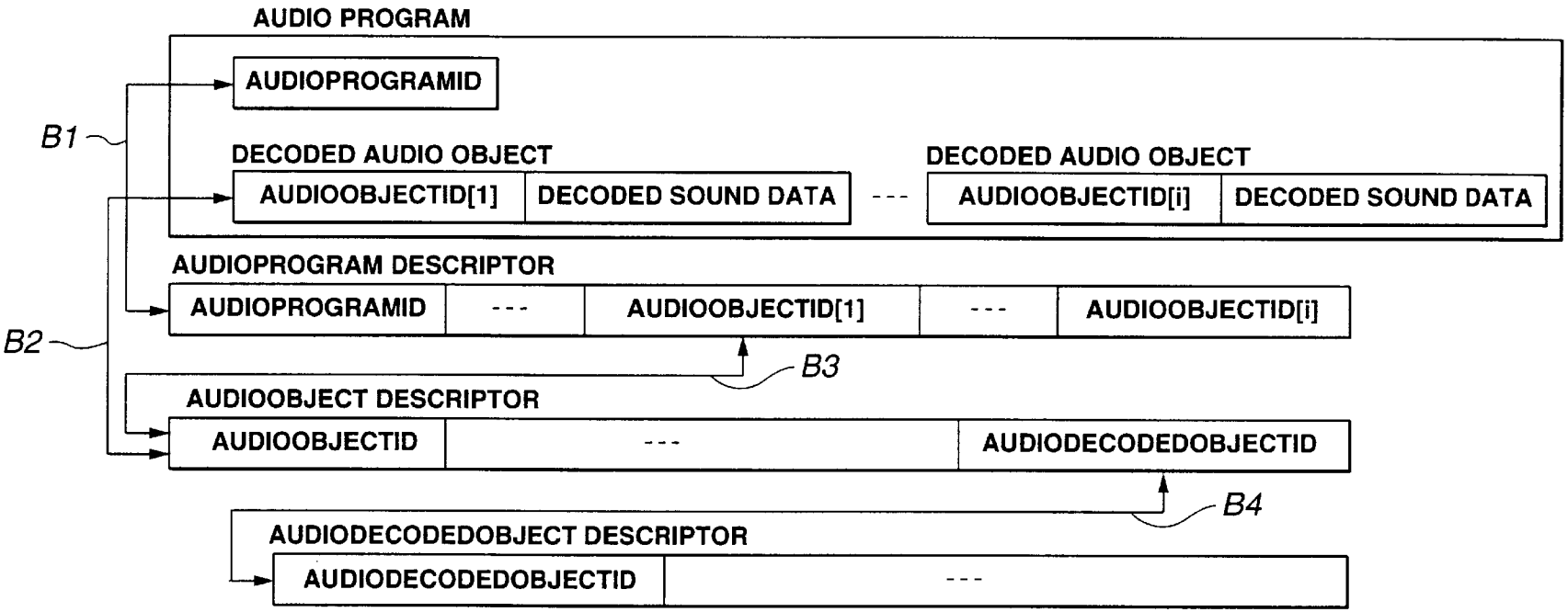
FIG. 8 is a diagram showing a recording form when recording descriptors together with sound data in case where sound data as a target to be recorded is decoded sound data.
Figure 9:
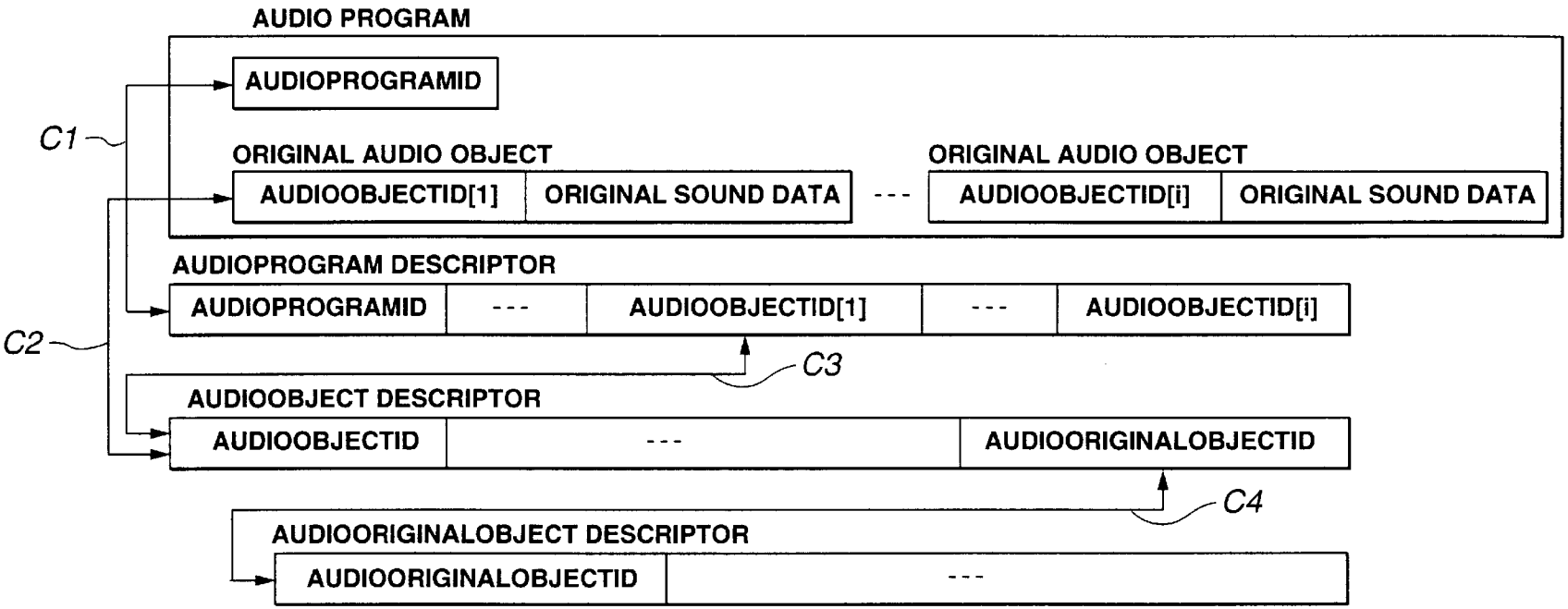
FIG. 9 is a diagram showing a recording form when recording descriptors together with sound data in case where sound data as a target to be recorded is original sound data.

The recording fonns when recording descriptors together with descriptors as described above will be explained with reference to FIGS. 7 to 9. In FIGS. 7 to 9, the arrows indicate reference correspondences between data pieces.

FIG. 7 shows a case where sound data as a target to be recorded is encoded sound data. At this time, the audio program is constructed by one or more encoded audio objects. Further, the audio program is added with identification information "AudioProgramID" which specifies the audio program by the data shaper section 15. Also, each audio object is added with identification information "AudioObjectID" which specifies the audio object by the data shaper section 15.

The identification information "AudioProgramID" added to the audio program is arranged so as to correspond to the "AudioProgramID" of the AudioProgram descriptor, as indicated by the arrow A1. Accordingly, by referring to the "AudioProgramID" added to an audio program, it is possible to specify the AudioProgram descriptor corresponding to the audio program. Similarly, by referring to the identification information "AudioProgramID" of the AudioProgram descriptor, it is possible to specify the audio program corresponding to the AudioProgram descriptor.

The "AudioObjectID" added to an audio object is arranged so as to correspond to the "AudioObjectID" of an AudioObject descriptor, as indicated by the arrow A2. Accordingly, by referring to the identification information "AudioObjectID" added to an audio object, it is possible to specify the AudioObject descriptor corresponding to the audio object. Similarly, by referring to the "AudioObjectID" of an AudioObject descriptor, it is possible to specify the audio object corresponding to the AudioObject descriptor.

The AudioProgram descriptor stores pieces of"AudioObjectID" corresponding in number to the number of audio objects which form part of a corresponding audio program, and each of the pieces of"AudioObjectID" is arranged so as to correspond to the "AudioObjectID" of a corresponding AudioObject descriptor, as indicated by the arrow A3.

The AudioObject descriptor stores the "AudioEncodedObjectID", and the "AudioEncodedObjectID" is arranged so as to correspond to the "AudioEncodedObjectID" of a corresponding AudioEncodedObject descriptor, as indicated by the arrow A4.

The AudioEncodedObject descriptor stores the "SpectralInfoID" which is arranged so as to correspond to the "SpectralInfoID" of a corresponding AudioEncodeSpectralInfo descriptor, as indicated by the arrow A5. Also, the AudioEncodeObject descriptor stores the "TemporalInfoID" which is arranged so as to correspond to the "TemporalInfoID" of a corresponding AudioEncodeTemporalInfo descriptor.

Note that the AudioEncodeSpectralInfo desciptor and the AudioEncodeTemporalInfo descriptor are not always indispensable but may be omitted. In this case, the "SpectralInfoID" and the "TemporalInfoID" are not stored in the AudioEncodedObject descriptor.

FIG. 8 shows a case where sound data as a target to be recorded is decoded sound data. At this time, the audio program is constructed by one or more decoded audio objects. Further, the audio program is added with identification information which specifies the audio program by the data shaper section 15. Also, each audio object is added with identification information "AudioObjectID" which specifies the audio object by the data shaper section 15.

The identification information "AudioProgramID" added to the audio program is arranged so as to correspond to the "AudioProgramID" of the AudioProgram descriptor, as indicated by the arrow B1. Accordingly, by referring to the "AudioProgramID" added to an audio program, it is possible to specify the AudioProgram descriptor corresponding to the audio program. Similarly, by referring to the "AudioProgramID" of an AudioProgram descriptor, it is possible to specify the audio program corresponding to the AudioProgram descriptor.

The identification information "AudioObjectID" added to the audio object is arranged so as to correspond to the "AudioObjectID" of the AudioObject descriptor, as indicated by the arrow B2. Accordingly, by referring to the "AudioObjectID" added to an audio object, it is possible to specify the AudioObject descriptor corresponding to the audio object. Similarly, by referring to the "AudioObjectID" of an AudioObject descriptor, it is possible to specify the audio object corresponding to the AudioObject descriptor.

The AudioProgram descriptor stores pieces of"AudioObjectID" corresponding in number to the number of audio objects which form part of a corresponding audio program, and each of the pieces of "AudioObjectID" is arranged so as to correspond to the "AudioObjectID" of a corresponding AudioObject descriptor, as indicated by the arrow B4.

The AudioObject descriptor stores the "AudioDecodedObjectID", and the "AudioDecodedObjectID" is arranged so as to correspond to the "AudioDecodedObjectID" of a corresponding AudioDecodedObject descriptor, as indicated by the arrow B4.

FIG. 9 shows a case where sound data as a target to be recorded is original sound data. At this time, the audio program is constructed by one or more original audio objects. Further, the audio program is added with identification information "AudioProgramID" which specifies the audio program by the data shaper section 15. Also, each audio object is added with identification information "AudioObjectID" which specifies the audio object by the data shaper section 15.

The identification information "AudioProgramID" added to the audio program is arranged so as to correspond to the "AudioProgramID" of the AudioProgram descriptor, as indicated by the arrow C1. Accordingly, by referring to the "AudioProgramID" added to an audio program, it is possible to specify the AudioProgram descriptor corresponding to the audio program. Similarly, by referring to the identification information "AudioProgramID" of the AudioProgram descriptor, it is possible to specify the audio program corresponding to the AudioProgram descriptor.

The "AudioObjectID" added to an audio object is arranged so as to correspond to the "AudioObjectID" of an AudioObject descriptor, as indicated by the arrow C2. Accordingly , by referring to the identification information "AudioObjectID" added to an audio object, it is possible to specify the AudioObject descriptor corresponding to the audio object. Similarly, by referring to the "AudioObjectID" of an AudioObject descriptor, it is possible to specify the audio object corresponding to the AudioObject descriptor.

The AudioProgram descriptor stores pieces of "AudioObjectID" corresponding in number to the number of audio objects which form part of a corresponding audio program, and each of the pieces of "AudioObjectID" is arranged so as to correspond to the "AudioObjectID" of a corresponding AudioObject descriptor, as indicated by the arrow C3.

The AudioObject descriptor stores the "AudioEncodedObjectID", and the "AudioOriginalObjectID" is arranged so as to correspond to the "AudioOriginalObjectID" of a corresponding AudioOriginalObject descriptor, as indicated by the arrow C4.

In the data processing apparatus 1, sound data is recorded together with descriptors onto the HDD 5, in accordance with the recording form as described above. Note that the HDD 5 in which sound data is thus recorded together with descriptors corresponds to the recording medium according to the present invention.

2. Search for Sound Data

Next, a search for sound data will be explained in more details. Explained now will be a case of an example in which sound data is searched from a recording medium on which descriptors are recorded together with sound data as described above.

<Structure of Data Processing Apparatus>

Explanation will be made of a data processing apparatus which makes a search for sound data among data processing apparatuses according to the present invention.

Figure 10:
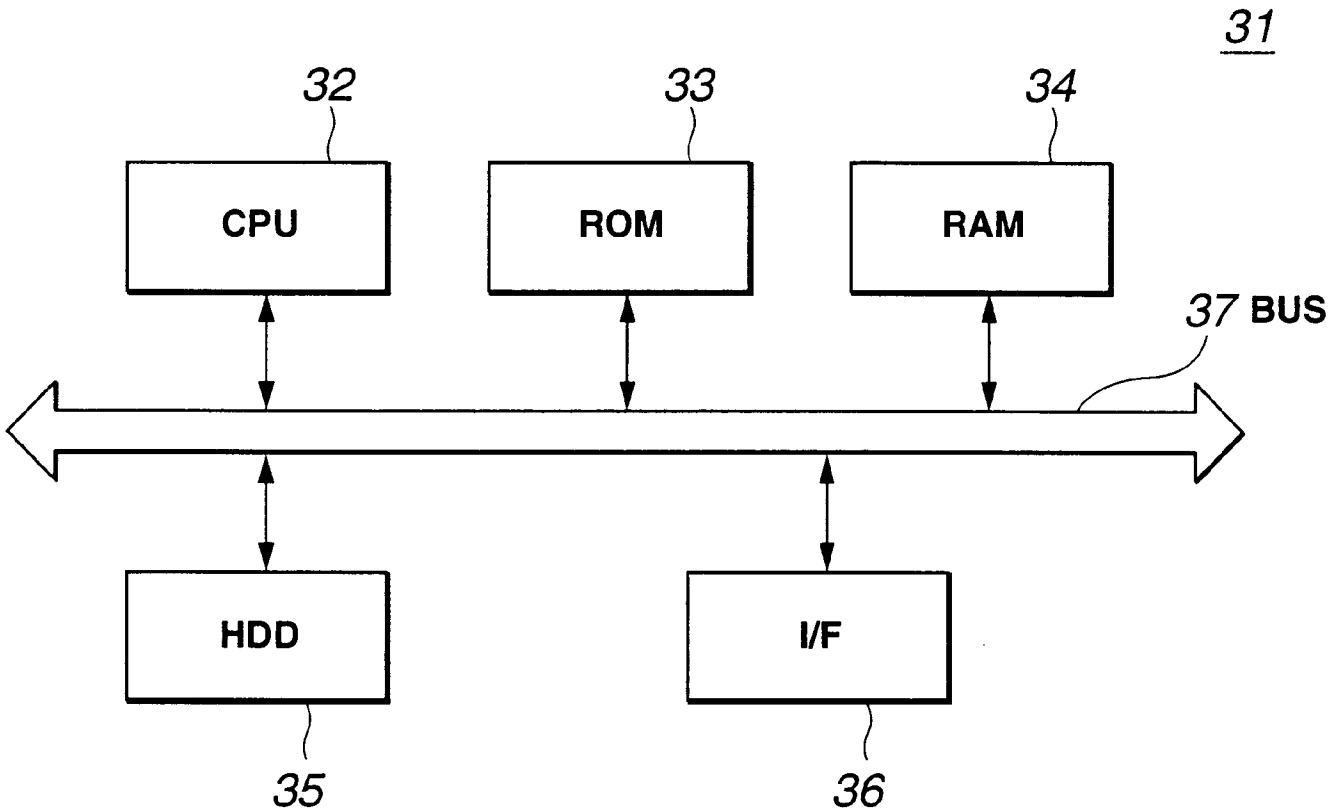
FIG. 10 is a block diagram showing a structural example of a data processing apparatus which performs a search for sound data by applying the present invention.

FIG. 10 shows an example of the structure of a data processing apparatus which makes a search for sound data by applying the present invention. This data processing apparatus 31 comprises a read-only memory (ROM) 33, a random access memory (RAM) 34, a hard disk drive (HDD) 35, and an interface (I/F) 36. These components are connected to a bus 37.

The CPU 32 transfers a search program stored in the HDD 35 to the RAM 34, based on the BIOS (Basic Input/Output System) program stored in the ROM 33. Further, the CPU 32 reads and executes the search program from the RAM 34. Note that this search program is a program in which processing for searching sound data by applying the present invention is described and the processing will be specifically explained later.

The HDD 35 is an external storage device in which arbitrary data is stored. In this case, at least, the search program described above and sound data as a target to be searched are previously stored. The sound data as the target to be searched is stored together with descriptors as described above.

Note that the HDD 35 in which the search program is stored corresponds to a program providing medium according to the present invention. The program providing medium according to the present invention, however, is not limited to the HDD 35 but any arbitrary recording medium can be used as long as the medium can store the search program or it is possible to provide a search program through a network.

The I/F 36 serves to input/output data. Inputting of a sound data search condition and outputting off a sound data search result are performed through the I/F 36. The I/F 36 is connected with, at least, an input device such as a keyboard, microphone, or the like, and an output device such as a display, speaker, or the like. Further, when searching sound data, a search condition is inputted through the I/F 36 from the input device such as a keyboard, microphone, or the like. Also, a result obtained by searching sound data is outputted from the output device such as a display, speaker, or the like.

<Functional Blocks of Data Processing Apparatus>

Figure 11:
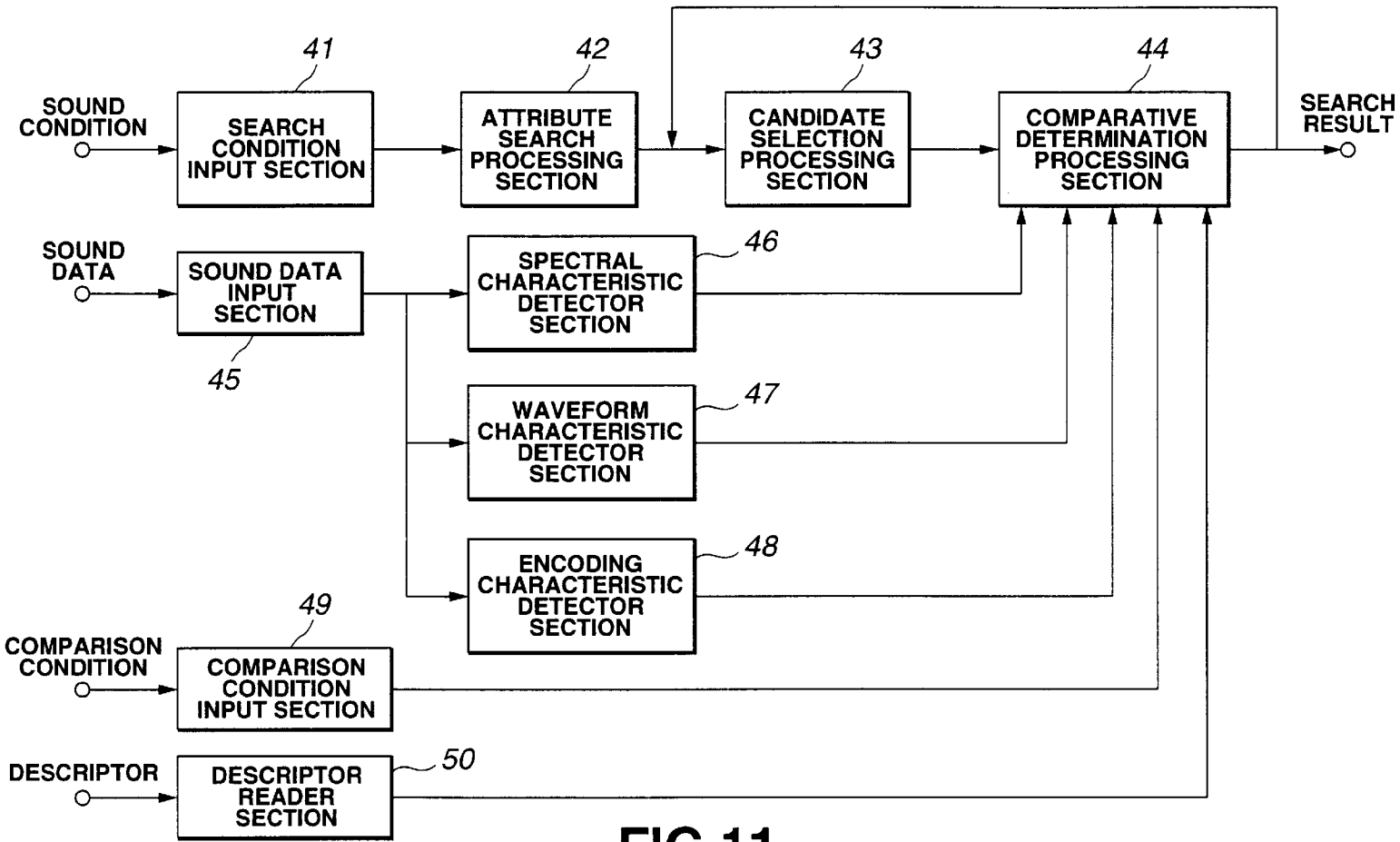
FIG. 11 is a block diagram showing a structural example of functional blocks with respect to a data processing apparatus which performs a search for sound data by applying the present invention.

The data processing apparatus 31 shown in FIG. 10 searches sound data stored in the HDD 35 by a data processing method which adopts the present invention, by executing a search program through the CPU 32. FIG. 11 shows an example of the structure of the functional blocks of the data processing apparatus 31 which perform this kind of data processing.

As shown in FIG. 11, the data processing apparatus 31 comprises a search condition input section 41 to which a search condition of sound data is inputted, an attribute search processing section 42 for searching sound data based on attribute information, a candidate selection processing section 43 for selecting sound data as a candidate for the search, and a comparative determination processing section 44 for determining whether or not the sound data selected by the candidate selection processing section 43 satisfies the search condition.

The data processing apparatus 31 comprises a sound data input section 45 to which sound data is inputted, a spectral characteristic detector section 46 for detecting a spectral characteristic from sound data inputted to the sound data input section 45, a waveform characteristic detector section 47 for detecting a waveform characteristic within a time area from the sound data inputted to the sound data input section, and an encoding characteristic detector section 48 for detecting an encoding characteristic from the sound data inputted to the sound data input section 45.

The data processing apparatus 31 comprises a comparative condition input section 49 to which a comparative condition when determining whether or not the sound data selected by the candidate selection processing section 43 satisfies the search condition is inputted, and a descriptor read section 50 for reading a descriptor stored in the HDD 35.

In this data processing apparatus 31, when searching sound data, the data of a search condition is inputted to the search condition input section 41 through the I/F 36. In case of searching sound data equal or similar to existing sound data, the existing sound data (which will be called search target sound data) is inputted to the sound data input section 45 through the I/F 36. In case of setting a comparative condition when determining whether or not the sound data selected by the candidate selection processing section 43 satisfies a search condition, data of the comparative condition is inputted to the comparative condition input section 49 through the I/F 36.

The data of the search condition inputted to the search condition input section 41 is supplied to the attribute search processing section 42. The attribute search processing section 42 searches sound data based on the data of the search condition received from the search condition input section 41. Here, the attribute search processing section 42 searches sound data using only the attribute information of the sound data as a search key. Accordingly, in many cases, a large number of sound data pieces are searched by the attribute search processing section 42. In the following explanation, the sound data searched by the attribute search processing section 42 is called search candidate sound data.

A result of searching sound data by the attribute search processing section 42 is supplied to the candidate selection processing section 43. The candidate selection processing section 43 selects one of search candidate sound data pieces, and supplies the selected result to the comparative determination processing section 44. In the following explanation, the search candidate sound data selected by the candidate selection processing section 43 will be called comparative target sound data.

If search target sound data is inputted to the sound data input section 45, the search target sound data is supplied to the spectral characteristic detector section 46 and the waveform characteristic detector section 47. If the search target sound data inputted to the sound data input section 45 is sound data subjected to predetermined encoding processing, the sound data is also supplied to the encoding characteristic detector section 48.

The spectral characteristic detector section 46 which has received the search target sound data detects a spectral characteristic from the search target sound data, and supplies spectral characteristic information thereof to the comparative determination processing section 44.

The waveform characteristic detector section 47 which has received the search target sound data detects a waveform characteristic within a time area from the search target sound data, and supplies waveform characteristic information thereof to the comparative determination processing section 44.

If the search target sound data is sound data subjected to predetermined encoding processing, the encoding characteristic detector section 48 which has received the search target sound data detects an encoding characteristic from the search target sound data, and supplies encoding characteristic information thereof to the comparative determination processing section 44.

If data of a comparative condition is inputted to the comparative condition input section 49, the data of the comparative condition is supplied to the comparative determination processing section 44 from the comparative condition input section 49. For example, the data of a comparative condition is, for example, data concerning the primrose of items to be compared when searching sound data, or data concerning the number of coefficients to be compared.

The comparative determination processing section 44 determines whether of not the search candidate sound data (which is comparative target sound data) is sound data which satisfies the search condition. Further, if the search candidate sound data is sound data which satisfies the search condition, the section 44 outputs the comparative target sound data or information concerning the comparative target sound data, as a search result. Otherwise, if the search candidate sound data is not sound data which satisfies the search condition, the section 44 sends an instruction to the candidate selection processing section 43 so as to select new search candidate sound data as bag comparative target sound data.

Here, if information of the spectral characteristic of the search target sound data is supplied from the spectral characteristic detector section 46, the comparative determination processing section 44 uses the information of the spectral characteristic to determine whether or not the comparative target sound data is sound data which satisfies the search condition.

Also, if information of the waveform characteristic of the search target sound data is supplied from the waveform characteristic detector section 47, the comparative determination processing section 44 uses the information of the waveform characteristic to determine whether or not the comparative target sound data is sound data which satisfies the search condition.

Also, if information of the comparative condition is supplied from the comparative condition input section 49, the comparative determination processing section 44 sets a comparative condition when determining whether or not the comparative target sound data is sound data which satisfies the search condition, based on data supplied from the comparative condition input section.

When whether or not the comparative target sound data is sound data which satisfies the search condition is determined by the comparative determination processing section 4, descriptors corresponding to the comparative target sound data are read from the HDD 35 and are supplied to the comparative determination processing section 44. Further, the comparative determination processing section 44 determines whether or not the comparative target sound data is sound data which satisfies the search condition, based on the descriptors.

As described above, in this data processing apparatus 31, when searching sound data, the sound data itself is not read but descriptors are read and sound data is searched based on the descriptors. Also described above, spectral characteristic information and waveform characteristic information on a time, which are previously detected from sound data, are recorded on the descriptors. Accordingly, if sound data is searched based on the descriptors, it is needless to compare the sound data itself but sound data can be efficiently and rapidly searched.

<Method of Searching Sound Data>

The data processing apparatus 31 shown in FIGS. 10 and 11 search sound data with reference to descriptors, by reading and executing a search program stored in the HDD 35.

Figure 12:
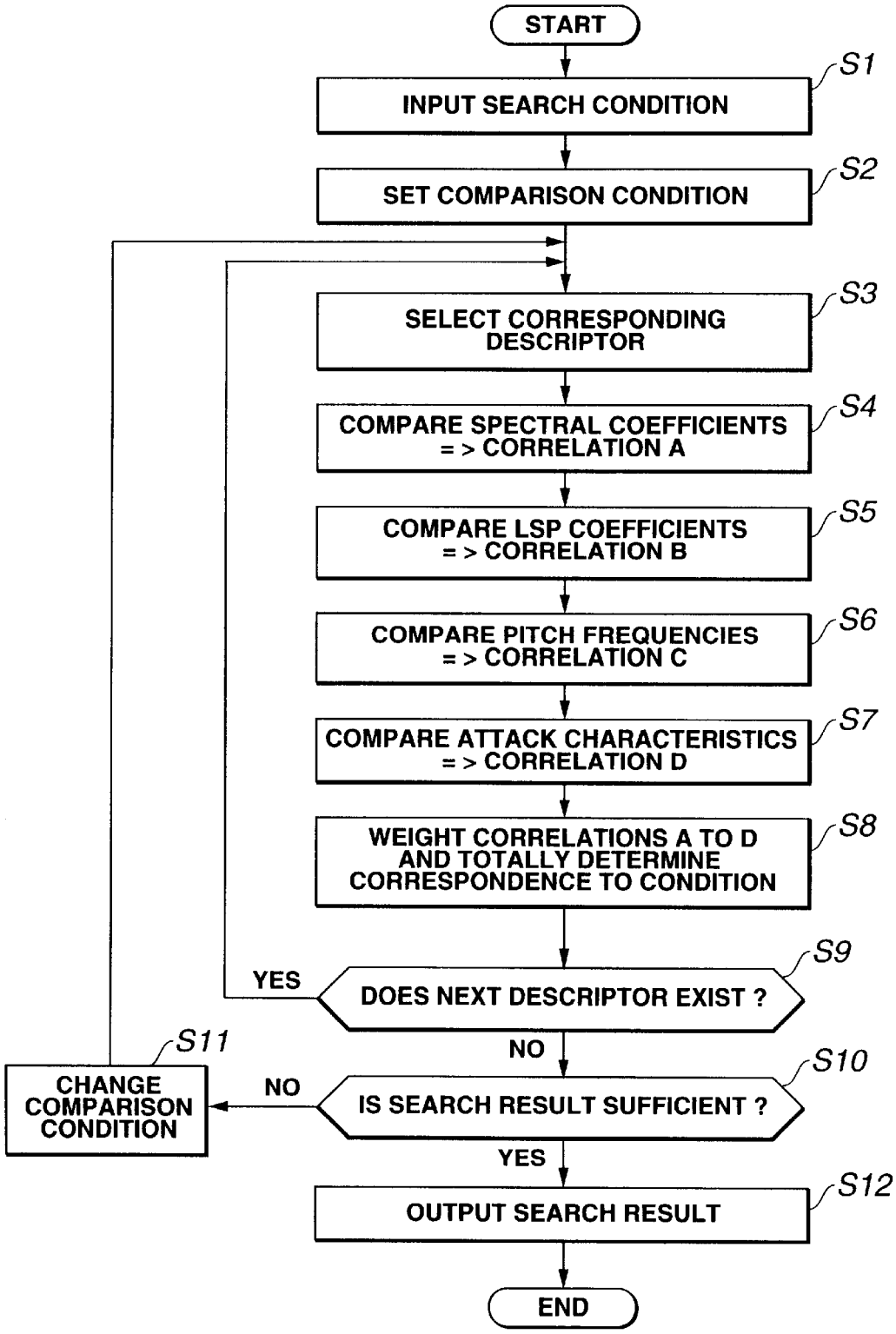
FIG. 12 is a flowchart showing an example of the flow of processing when searching sound data by applying the present invention.

In the following, the method of searching sound data, which is executed based on the search program, will be explained with reference to the flowchart shown in FIG. 12. In this case, explanation will be made with reference to an example of a case in which search target sound data is inputted to the sound data input section 45 and sound data equal or similar to the search target sound data is searched.

When searching sound data by the data processing apparatus, at first, a search condition is inputted through the I/F 36 in the step SI, and search target sound data is inputted to the sound data input section 45 through the I/F 36.

Here, attribute information of search target sound data is inputted as a search condition to the search condition input section 41. For example, attribute information such as the classification, title, and copyright information of the search target sound data is inputted as a search condition to the search condition input section 41. Note that the classification of sound data corresponds to the "AudioProgramCategory" of the descriptor, the title of sound data to the "AudioProgramName", as well as the copyright information of sound data to the "AudioProgramAuthInfo".

Also, the data inputted to the sound data input section 45 is supplied to the spectral characteristic detector section 46, the waveform characteristic detector section 47, and the encoding characteristic detector section 48. Further, various characteristics are detected and characteristic information thus detected is sent to the comparative determination processing section 44. For example, the spectral coefficient, LSP coefficient, pitch frequency, attack characteristic, and the like are detected from the search target sound data, and characteristic information thereof is sent to the comparative determination processing section 44. Note that the spectral coefficient corresponds to the "SpectralCoeff" of the descriptor, the LSP coefficient to the "LspParameter", as well as the pitch frequency to the "PitchFrequency" of the descriptor". Also, the attack chracteristic corresponds to the "AttackNum", "AttackLocation", the "AttackLevel", and the like of the descriptor.

Next, in the step S2, a comparative condition is inputted to the comparative condition input section 49 through the I/F 36, to set a comparative condition. For example, the priorities of comparative items, the number of spectral coefficients, and the like are inputted as a comparative condition to the comparative condition input section 49. Note that the initial value of the priority of the comparative item is set in the "PriorityLevel" of the descriptor. Also, as for the number of spectral coefficients to be compared, the value set in the "SpectralUsedNurnber" is the upper limit.

Next, in the step S3, a descriptor corresponding to the comparative sound data is selected, and the descriptor is read from the HDD 35 by the descriptor read section 50. Specifically, at first, search candidate sound data pieces are selected by the attribute search processing section 42, based on the search condition inputted to the search condition input section 41. Next, one of the search candidate sound data pieces is selected by the search candidate selection processing section 43. Further, the descriptor corresponding to the selected search candidate sound data piece (which is the comparative target sound data) is read from the HDD 35 by the descriptor read section 50, and is supplied to the comparative determination processing section 44.

Next, in the step S4, based on the comparative condition which has been set, the spectral coefficient or the like detected from the search target sound data are compared with the spectral coefficient or the like described in the descriptor selected in the step S3, to obtain a correlation therebetween (which will be hereinafter called a correlation A). In this case, for example, the normalization coefficient (scale factor) expressing the amplitude gain of the spectrum or the code book number of the optimal code book when encoding the spectrum may be used as a comparative target than the spectral coefficient.

Next, in the step S5, based on the comparative condition which has been set, the LSP coefficient or the like detected from the search target sound data is compared with the LSP coefficient or the like described in the descriptor selected in the step S3, to obtain a correlation therebetween (which will be hereinafter called a correlation B).

Next, in the step S6, based on the comparative condition which has been set, the pitch frequency or the like detected from the search target sound data is compared with the pitch frequency or the like described in the descriptor selected in the step S3, to obtain a correlation therebetween (which will be hereinafter called a correlation C).

Next, in the step S7, based on the comparative condition which has been set, the attack characteristic or the like detected from the search target sound data is compared with the attack characteristic or the like described in the descriptor selected in the step S3, to obtain a correlation therebetween (which will be hereinafter called a correlation D).

Next, in the step S8, based on the comparative condition which has been set, the correlations A, B, and C are weighted to deternine totally whether or not the contents described in the descriptor selected in the step S3 match with the search condition.

Next, in the step S9, whether or not a descriptor as a comparative target still remains is detennined. If a descriptor as a comparative target remains, the flow returns to the step S3 and the processing is repeated. That is, if search candidate sound data still remains, new search candidate sound data is selected as comparative target sound data, and a descriptor corresponding to the comparative sound data is selected. The processing from the step S3 to the step S8 is repeated.

Meanwhile, in the step S9, if a descriptor as a comparative target does not remain, the flow goes to the step S10. That is, by repeating the processing from the step S3 to the step S9, whether or not the search candidate sound data matches with the search condition is totally determined as for each of the search candidate sound data pieces searched by the attribute search processing section 42. If determinations are completed for all the search candidate sound data pieces, the flow goes to the step In the step S10, whether or not the results searched in the previous steps are sufficient is determined. If not sufficient, the flow goes to the step S11. If sufficient, the flow goes to the step S12.

In the step S1, the comparative condition is changed. For example, the priorities of the comparative items (e.g., weights applied to the correlations A, B, C, and D) or the number of spectral coefficients to be compared is changed. Further, after the comparative condition is thus changed, the flow returns to the step S3 and the processing is repeated. Further, if sufficient search results are obtained by repeating the processing from the step S3 to the step S11, the flow goes to the step S12.

In the step S12, the results searched by the above steps are outputted. For example, the searched sound data itself, the attribute information of the searched sound data, data related to the searched sound data, and the like are outputted to an output device through the I/F 36.

The outputting of data related to the searched sound data means, for example, that if the search target sound data is encoded sound data, the attribute information of the original sound data which bases the search target sound data is outputted or the attribute information of the decoded sound data obtained by decoding the search target sound data is outputted. These information items can be searched by referring to the "AudioEncodedObjectID", "AudioOriginalObjectID", "AudioDecodedObjectID", and the like of the descriptor.

In the above example, the spectral coefficient, LSP coefficient, pitch frequency, attack characteristic, and the like are cited as comparative target items. Needless to say, however, these items can be appropriately changed in accordance with the search condition.

As described above, by searching sound data with reference to descriptors, sound data can be efficiently searched without decoding sound data. In particular, if a number of characteristic information items are described in a descriptor, it is possible to compositely search sound data from the number of characteristic information items with efficiency and rapidness. Further, sound data related to certain sound data can be searched easily by referring to the "AudioEncodedObjectID", "AudioOriginalObjectID", "AudioDecodedObjectID", and the like of the descriptor.

What is claimed is:

1. A data processing apparatus comprising:

sound data input means inputted with sound data;

spectral characteristic information detector means for detecting spectral characteristic information from the sound data inputted to the sound data input means;

waveform characteristic information detector means for detecting waveform characteristic information within a time area from the sound data inputted to the sound data input means; and recording means for recording the spectral characteristic information detected by the spectral characteristic information detector means and the waveform characteristic information detected by the waveform characteristic information detector means, together with a first identifier information indicating a correspondence relationship of the first identifier information with the sound data inputted to the sound data input means, and for recording the sound data together with a second identifier information indicating a correspondence relationship of the sound data with the first identifier information.

2. An apparatus according to claim 1, further comprising attribute information input means inputted with attribute information concerning the sound data inputted to the sound data input means, wherein the recording means records the attribute information inputted to the attribute information input means together with information indicating a correspondence relationship with the sound data inputted to the sound data input means.

3. An apparatus according to claim 1, wherein the spectral characteristic information detector means detects at least one of a harmonic of a LPC residual signal spectrum, a LSP parameter, a pitch frequency, a spectral characteristic, a normalization coefficient of the spectral coefficient, and information concerning a code book, as the spectral characteristic information, from the sound data.

4. An apparatus according to claim 1, wherein the waveform characteristic information detector means detects at least one of a number of attacks, a position of attacks, an attack level, a power average value, and a pitch frequency, as the waveform characteristic within the time area, from the sound data.

5. An apparatus according to claim 1, wherein the sound data inputted to the sound data input means is encoded sound data obtained by performing predetermined compression encoding processing on sound data, sound data before performing compression encoding processing, or decoded sound data obtained by performing predetermined decoding processing on encoded sound data.

6. A data processing method comprising:

a spectral characteristic detecting step of detecting a spectral characteristic from sound data;

a waveform characteristic information detecting step of detecting waveform characteristic information within a time area from the sound data; and a recording step of recording the spectral characteristic information detected in the spectral characteristic information detecting step and the waveform characteristic information detected in the waveform characteristic information detecting step, together with a first identifier information indicating a correspondence relationship of the first identifier information with the sound data, and recording the sound data together with a second identifier information indicating a correspondence relationship of the sound data with the first identifier information.

7. A method according to claim 6, further comprising an attribute information input step in which attribute information concerning the sound data is inputted, wherein in the recording step, the attribute information inputted in the attribute information input step is recorded together with information indicating the correspondence with the sound data.

8. A method according to claim 6, wherein in the spectral characteristic information detecting step, at least one of a harmonic of a LPC residual signal spectrum, a LSP parameter, a pitch frequency, a spectral characteristic, a normalization coefficient of the spectral coefficient, and information concerning a code book is detected as the spectral characteristic information from the sound data.

9. A method according to claim 6, wherein in the waveform characteristic information detecting step, at least one of a number of attacks, a position of attacks, an attack level, a power average value, and a pitch frequency, as the waveform characteristic within the time area is detected from the sound data.

10. A method according to claim 6, wherein the sound data is encoded sound data obtained by performing predetermined compression encoding processing on sound data, sound data before performing compression encoding processing, or decoded sound data obtained by performing predetermined decoding processing on encoded sound data.

11. A program providing medium for providing a program which makes a computer execute processing comprising:

a spectral characteristic detecting step of detecting a spectral characteristic from sound data;

a waveform characteristic information detecting step of detecting waveform characteristic information within a time area from the sound data; and a recording step of recording the spectral characteristic information detected in the spectral characteristic information detecting step and the waveform characteristic information detected in the waveform characteristic information detecting step, together with a first identifier information indicating a correspondence relationship of the first identifier information with the sound data, and recording the sound data together with a second identifier information indicating a correspondence relationship of the sound data with the first identifier information.

12. A data processing apparatus comprising:

search condition input means inputted with a search condition for sound data; and search means for searching sound data based on the search condition inputted to the search condition input means, wherein the search means searches sound data which satisfies the search condition by referring to at least spectral characteristic information and waveform characteristic information within a time area, which are previously detected and recorded, from sound data, the spectral characteristic information and waveform characteristic information being recorded with a first identifier information indicating a correspondence relationship of the first identifier information with the sound data, and the sound data being recorded together with a second identifier information indicating a correspondence relationship of the sound data with the first identifier information.

13. An apparatus according to claim 12, wherein the search condition includes attribute information concerning sound data as a search target, and the search means searches sound data which satisfies the search condition by referring to the attribute information.

14. An apparatus according to claim 12, further comprising:

sound data input means inputted with sound data;

spectral characteristic information detector means for detecting spectral characteristic information from the sound data inputted to the sound data input means; and waveform characteristic information detector means for detecting waveform characteristic information within a time area from the sound data inputted to the sound data input means, wherein if the search condition inputted to the search condition input means is a condition that sound data equal to or similar to the sound data inputted to the sound data input means should be searched, the search means searches the sound data equal to or similar to the sound data inputted to the sound data input means, by comparing the spectral characteristic information detected by the spectral characteristic information detector means and the waveform characteristic information within the time area detected by the waveform characteristic information detector means, with the spectral characteristic information and the waveform characteristic information within the time area which are previously detected from sound data and recorded.

15. An apparatus according to claim 12, wherein the spectral characteristic information previously detected from sound data and recorded contains at least one of a harmonic of a LPC residual signal spectrum, a LSP parameter, a pitch frequency, a spectral characteristic, a normalization coefficient of the spectral coefficient, and information concerning a code book, as the spectral characteristic information, from the sound data.

16. An apparatus according to claim 12, wherein the waveform characteristic information previously detected from sound data and recorded contains at least one of a number of attacks, a position of attacks, an attack level, a power average value, and a pitch frequency, as the waveform characteristic within the time area, from the sound data.

17. An apparatus according to claim 12, wherein the sound data as a target to be searched by the search means is encoded sound data obtained by performing predetermined compression encoding processing on sound data, sound data before performing compression encoding processing, or decoded sound data obtained by performing predetermined decoding processing on encoded sound data.

18. A data processing method comprising:

a search condition input step in which a search condition for sound data is inputted; and a search step of searching sound data based on the search condition inputted in the search condition input step, wherein in the search step, sound data which satisfies the search condition is searched by referring to at least spectral characteristic information and waveform characteristic information within a time area, which are previously detected and recorded, from sound data, and wherein the spectral characteristic information and waveform characteristic information are recorded with a first identifier information indicating a correspondence relationship of the first identifier information with the sound data, and the sound data is recorded together with a second identifier information indicating a correspondence relationship of the sound data with the first identifier information.

19. A method according to claim 18, wherein the search condition inputted in the search condition input step includes attribute information concerning sound data as a search target, and in the search step, sound data which satisfies the search condition is searched by referring to the attribute information.

20. A method according to claim 18, further comprising:

a sound data input step in which sound data is inputted;

a spectral characteristic information detecting step of detecting spectral characteristic information from the sound data inputted in the sound data input step; and a waveform characteristic information detecting step of detecting waveform characteristic information within a time area from the sound data inputted in the sound data input step, wherein if the search condition inputted in the search condition input step is a condition that sound data equal to or similar to the sound data inputted in the sound data input step should be searched, the sound data equal to or similar to the sound data inputted in the sound data input step is searched in the search step by comparing the spectral characteristic information detected in the spectral characteristic information detecting step and the waveform characteristic information within the time area detected by the waveform characteristic information detecting step, with the spectral characteristic information and the waveform characteristic information within the time area which are previously detected from sound data and recorded.

21. A method according to claim 18, wherein the spectral characteristic information previously detected from sound data and recorded contains at least one of a harmonic of a LPC residual signal spectrum, a LSP parameter, a pitch frequency, a spectral characteristic, a normalization coefficient of the spectral coefficient, and information concerning a code book, as the spectral characteristic information, from the sound data.

22. A method according to claim 18, wherein the waveform characteristic information previously detected from sound data and recorded contains at least one of a number of attacks, a position of attacks, an attack level, a power average value, and a pitch frequency, as the waveform characteristic within the time area, from the sound data.

23. A method according to claim 18, wherein the sound data as a target to be searched in the search step is encoded sound data obtained by performing predetermined compression encoding processing on sound data, sound data before performing compression encoding processing, or decoded sound data obtained by performing predetermined decoding processing on encoded sound data.

24. A program providing medium for providing a program which makes a computer execute processing comprising:

a search condition input step in which a search condition for sound data is inputted; and a search step of referring to at least spectral characteristic information and waveform characteristic information within a time area which are previously detected from sound data and recorded, thereby to search sound data which satisfies the search condition inputted in the search condition input step, wherein the spectral characteristic information and waveform characteristic information are recorded with a first information indicating a correspondence relationship of the first identifier information with the sound data, and the sound data is recorded together with a second identifier information indicating a correspondence relationship of the sound data with the first identifier information.

25. A recording medium on which sound data is recorded and spectral characteristic information detected from the sound data and waveform characteristic information within a time area detected from the sound data are recorded together with a first identifier information indicating a correspondence relationship of the first identifier information with the sound data, and the sound data being recorded together with a second identifier information indicating a correspondence relationship of the sound data with the first identifier information.

* * * * *